US009972250B2

(12) United States Patent
Toyomura

(10) Patent No.: US 9,972,250 B2
(45) Date of Patent: May 15, 2018

(54) DISPLAY APPARATUS AND DRIVE METHOD OF DISPLAY APPARATUS

(71) Applicant: Sony Corporation, Tokyo (JP)

(72) Inventor: Naobumi Toyomura, Kanagawa (JP)

(73) Assignee: Sony Corporation, Tokyo (JP)

( * ) Notice: Subject to any disclaimer, the term of this patent is extended or adjusted under 35 U.S.C. 154(b) by 356 days.

(21) Appl. No.: 14/640,530

(22) Filed: Mar. 6, 2015

(65) Prior Publication Data

US 2015/0279279 A1 Oct. 1, 2015

(30) Foreign Application Priority Data

Mar. 26, 2014 (JP) ..... 2014-063582

(51) Int. Cl.
*G09G 3/20* (2006.01)
*G09G 3/3266* (2016.01)
*G09G 3/3233* (2016.01)

(52) U.S. Cl.
CPC ..... *G09G 3/3266* (2013.01); *G09G 3/3233* (2013.01); *G09G 2300/0819* (2013.01);
(Continued)

(58) Field of Classification Search
CPC ..... G09G 2310/06; G09G 2310/061; G09G 2310/062; G09G 2310/063; G09G 2310/065; G09G 2310/066; G09G 2310/067; G09G 2310/068; G09G 2310/08; G09G 2310/0216; G09G 2310/0202; G09G 2310/00; G09G 3/3266; G09G 3/3233; G09G 2300/0819; G09G 2300/0866; G09G 2310/0218; G09G 2310/0251; G09G 2320/043; G09G 2330/04; G09G 2330/043; G09G 2330/12; G09G 2320/0252; G09G 2320/0223; G09G 2310/0243; G09G 2310/0224; G09G 2310/0227;
(Continued)

(56) References Cited

U.S. PATENT DOCUMENTS 9,336,711 B2 * 5/2016 Toyomura ..... G09G 3/3233
2004/0239603 A1 * 12/2004 Toriumi ..... G09G 3/3688 345/89

(Continued)

FOREIGN PATENT DOCUMENTS

JP 2009-122352 6/2009

*Primary Examiner* — Julie Anne Watko
(74) *Attorney, Agent, or Firm* — Michael Best & Friedrich LLP

(57) ABSTRACT

Provided is a display apparatus including: a pixel array unit configured such that a pixel circuit including a light emitting unit, a writing transistor, and a drive transistor is arranged in a matrix form; a signal output unit configured to output video signals to signal lines during a plurality of horizontal periods corresponding to the number of rows in a unit; a writing and scanning unit configured to output scanning signals; and a selector circuit unit configured to select, in turn, the plurality of scanning signals and allocate the selected scanning signal to each of scanning lines of a unit of pixel rows, wherein a selection assigned period in a display frame period of the selection transistor is divided into a plurality of periods, and a desired voltage is applied to a gate electrode of the selection transistor during a specific period other than the selection assigned period.

15 Claims, 10 Drawing Sheets

(52) U.S. Cl.
CPC ..... *G09G 2300/0866* (2013.01); *G09G 2310/0216* (2013.01); *G09G 2310/0218* (2013.01); *G09G 2310/0224* (2013.01); *G09G 2310/0251* (2013.01); *G09G 2310/062* (2013.01); *G09G 2310/067* (2013.01); *G09G 2310/08* (2013.01); *G09G 2320/043* (2013.01); *G09G 2330/04* (2013.01)

(58) Field of Classification Search
CPC ... G09G 2310/0229; G09G 2300/0871; G09G 2300/0814; G09G 2300/0439; G09G 2300/04; G09G 2300/00; G09G 3/0325; G09G 3/03241; G09G 3/03233; G09G 3/03225; G09G 3/30; G09G 3/3208; G09G 3/32; G09G 3/0416; G09G 2310/02; G09G 2300/0842; G06F 3/0416
USPC ..... 345/212
See application file for complete search history.

(56) References Cited

U.S. PATENT DOCUMENTS

2007/0063958 A1* 3/2007 Toyozawa ..... G09G 3/20 345/98
2009/0122053 A1* 5/2009 Yamamoto ..... G09G 3/3233 345/213
2016/0358570 A1* 12/2016 Wang ..... G09G 3/3677

* cited by examiner

DISPLAY APPARATUS AND DRIVE METHOD OF DISPLAY APPARATUS

CROSS REFERENCE TO RELATED APPLICATIONS

This application claims the benefit of Japanese Priority Patent Application JP 2014-063582 filed Mar. 26, 2014, the entire contents of which are incorporated herein by reference.

BACKGROUND

The present disclosure relates to a display apparatus and a drive method of the display apparatus.

Among display apparatuses, there is a display apparatus with a configuration in which a plurality of pixel rows (horizontal lines) of the respective pixels (pixel circuits) in a pixel array unit are made to function as a unit and a plurality of scanning signals supplied in a time-series manner in accordance with a unit of the plurality of pixel rows are selected in turn and supplied to each of the plurality of pixel rows (see Japanese Unexamined Patent Application Publication No. 2009-122352, for example).

Such a type of display apparatus includes a selector circuit unit, which is configured to select the plurality of scanning signals in turn and allocate the selected scanning signal to each pixel row in a unit of the plurality of pixel rows, and which is provided between a scanning unit configured to output, in the time-series manner, the plurality of scanning signals corresponding to a unit of the plurality of pixel rows and scanning lines arranged for the respective pixel rows in a pixel array unit.

SUMMARY

In the selector circuit unit, the selected signals (selected pulses) are continuously applied to a transistor which configures the selector circuit unit, namely a selection transistor which selects the plurality of scanning signals, for a display frame period. If one of a positive voltage and a negative voltage applied thereto has a greater influence at this time, properties of the selection transistor temporally vary in some cases due to the properties of the selection transistor, for example. In addition, there is a possibility in that an operation failure occurs in the selector circuit unit if the properties of the selection transistor vary.

It is desirable to provide a display apparatus and a drive method of the display method capable of preventing an operation failure in the selector circuit unit, which is caused by temporal variations in properties of the selection transistor configuring the selector circuit unit.

According to an embodiment of the present disclosure, there is provided a display apparatus including: a pixel array unit configured such that a pixel circuit including a light emitting unit, a writing transistor for writing video signals, and a drive transistor for driving the light emitting unit based on the video signals written by the writing transistor is arranged in a matrix form; a signal output unit configured to regard a plurality of pixel rows in the pixel array unit as a unit and output, in a time-series manner, a plurality of video signals corresponding to a unit of the plurality of pixel rows to signal lines arranged respectively for pixel columns in the pixel array unit during a plurality of horizontal periods corresponding to the number of rows in a unit; a writing and scanning unit configured to output, in the time-series manner, a plurality of scanning signals for writing the signals, which correspond to a unit of the plurality of pixel rows; and a selector circuit unit configured to select, in turn, the plurality of scanning signals for writing the signals, which are output from the writing and scanning unit in the time-series manner, and allocate the selected scanning signal to each of scanning lines of a unit of the plurality of pixel rows, wherein in the selector circuit unit, a selection assigned period in a display frame period of the selection transistor configuring the selector circuit unit is divided into a plurality of periods, and a desired voltage is applied to a gate electrode of the selection transistor during a specific period other than the selection assigned period.

According to another embodiment of the present disclosure, there is provided a drive method of a display apparatus which includes a pixel array unit configured such that a pixel circuit including a light emitting unit, a writing transistor for writing video signals, and a drive transistor for driving the light emitting unit based on the video signals written by the writing transistor is arranged in a matrix form, a signal output unit configured to regard a plurality of pixel rows in the pixel array unit as a unit and output, in a time-series manner, a plurality of video signals corresponding to a unit of the plurality of pixel rows to signal lines arranged respectively for pixel columns in the pixel array unit during a plurality of horizontal periods corresponding to the number of rows in a unit, a writing and scanning unit configured to output, in the time-series manner, a plurality of scanning signals for writing the signals, which correspond to a unit of the plurality of pixel rows, and a selector circuit unit configured to select, in turn, the plurality of scanning signals for writing the signals, which are output from the writing and scanning unit in the time-series manner, and allocate the selected scanning signal to each of scanning lines of a unit of the plurality of pixel rows, the method including: dividing a selection assigned period in a display frame period of the selection transistor configuring the selector circuit unit into a plurality of periods; and applying a desired voltage to a gate electrode of the selection transistor during a specific period other than the selection assigned period.

According to the display apparatus or the drive method of the display apparatus with the aforementioned configurations, it is possible to freely set a voltage as a voltage to be applied to the gate electrode of the selection transistor during a period other than the selection assigned period by dividing the selection assigned period in a display frame period of the selection transistor into a plurality of periods. Thus, it is possible to suppress temporal variations in properties of the selection transistor even if the selection transistor is greatly affected by one of a positive voltage and a negative voltage applied thereto, by applying the desired voltage to the gate electrode of the selection transistor during the specific period other than the selection assigned period.

According to the present disclosure, it is possible to suppress temporal variations in properties of the selection transistor which configures the selector circuit unit and to thereby prevent an operation failure in the selector circuit unit, which is caused by the temporal variations in properties of the selection transistor.

The present disclosure is not necessarily limited to the effects described herein, and any effects described in the specification may be achieved. In addition, the effects are described in the specification only for an illustrative purpose. The present disclosure is not limited thereto, and additional effects may be achieved.

DETAILED DESCRIPTION OF EMBODIMENTS

Figure 1:
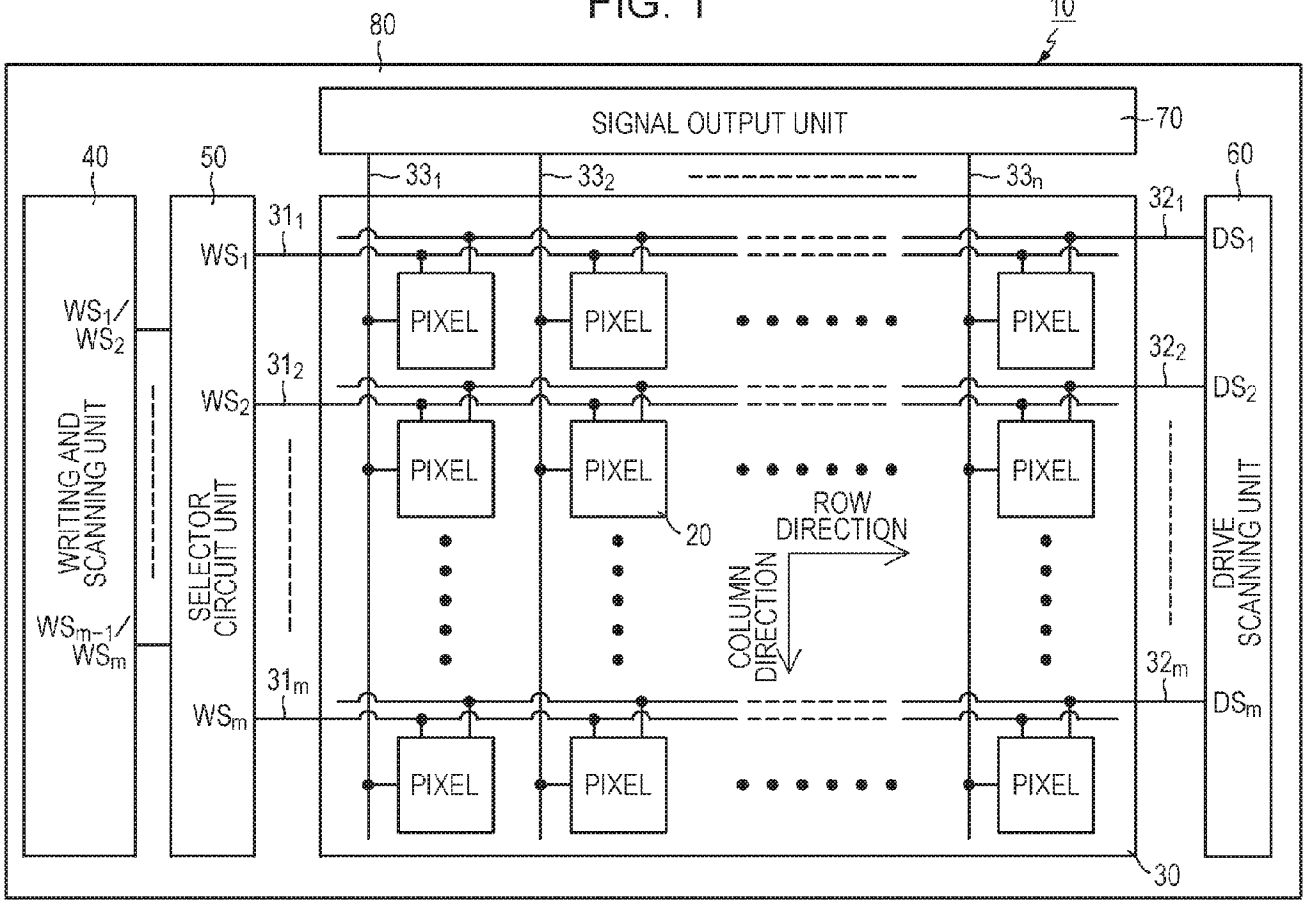
FIG. 1 is a system configuration diagram schematically illustrating a basic configuration of an active matrix-type display apparatus according to an embodiment of the present disclosure.

Hereinafter, a configuration for implementing the technique of the present disclosure (hereinafter, referred to as an "embodiment") will be described in detail with reference to drawings. The technique of the present disclosure is not limited to the embodiments, and various numerical values in the embodiment will be described only for an illustrative purpose. In the following description, the same reference numerals will be used for the same components or components with the same functions, and descriptions thereof will not be repeated. In addition, descriptions will be given in the following order.

1. General Description Concerning Display Apparatus and Drive Method of Display Apparatus According to Present Disclosure
2. Active Matrix-Type Display Apparatus (Example of Organic EL Display Apparatus) According to Embodiment
2-1. System Configuration
2-2. Pixel Circuit
2-3. Basic Circuit Operations
2-4. Selector Circuit Unit According to Reference Example
2-5. Selector Circuit Unit According to Embodiment
3. Modification Example General Description Concerning Display Apparatus and Drive Method of Display Apparatus According to Present Disclosure According to a display apparatus and a drive method of the display apparatus of the present disclosure, it is possible to configure a pixel circuit so as to have a function of threshold value correction processing for causing a source voltage of a drive transistor to vary toward a voltage obtained by subtracting a threshold voltage of the drive transistor from an initialization voltage of a gate voltage of the drive transistor. At this time, it is possible to configure a signal output unit such that a reference voltage, which functions as an initialization voltage of the threshold value correction processing, is output to signal lines prior to the output of a plurality of video signals corresponding to a unit of a plurality of pixel rows.

According to the display apparatus and the drive method of the display apparatus of the present disclosure including the aforementioned preferred configuration, it is possible to configure a writing and scanning unit so as to output a scanning signal for threshold value correction which is common to a unit of the plurality of pixel rows prior to the output of a plurality of scanning signals for writing the signals, which correspond to a unit of the plurality of pixel rows. At this time, it is possible to configure a selector circuit unit so as to select scanning signals for threshold value correction, which is output from the writing and scanning unit, at the same timing for a unit of the plurality of pixel rows.

According to the display apparatus and the drive method of the display apparatus of the present disclosure including the aforementioned preferred configuration, it is possible to employ such a form in that a desired voltage is a voltage suppressing shift of properties of the selection transistor, which is being driven, in a specific direction. In addition, it is possible to employ such a form in that when the selection transistor is an N-channel-type transistor, a negative voltage is set as the desired voltage in a case where the properties of the selection transistor tend to shift in an enhancement direction and a positive voltage is set as the desired voltage in a case where the properties of the selection transistor tend to shift in a depletion direction.

According to the display apparatus and the drive method of the display apparatus of the present disclosure including the aforementioned configuration and forms, it is possible to employ such a form in that the desired voltage is a constant voltage or a pulse voltage. It is possible to employ such a form in that when the desired voltage is a constant voltage, the constant voltage is applied during an entire period other than a selection assigned period of the selection transistor. In such a case, the specific period other than the selection assigned period of the selection transistor corresponds to the entire period other than the selection assigned period. It is possible to employ such a form in that when the desired voltage is a pulse voltage, the pulse voltage is applied during a predetermined period other than the selection assigned period of the selection transistor. In such a case, the specific period other than the selection assigned period of the selection transistor corresponds to the predetermined period other than the selection assigned period.

Active Matrix-Type Display Apparatus According to Embodiment System Configuration FIG. 1 is a system configuration diagram schematically illustrating a basic configuration of an active matrix-type display apparatus according to an embodiment of the present disclosure.

The active matrix-type display apparatus is a display apparatus configured such that a current flowing through a light emitting element (light emitting unit) is controlled by an active element provided in the same pixel circuit as that of the light emitting element, for example, by an insulated gate field-effect transistor. As a typical example of the insulated gate field-effect transistor, it is possible to use a thin film transistor (TFT).

Here, an active matrix-type organic EL display apparatus in which organic EL elements, for example, are used as the light emitting elements in the pixel circuit will be exemplified and described. The organic EL elements are electro-optical elements of a current drive type which emit light with illuminance varying in accordance with a value of a current flowing through a device. Hereinafter, the "pixel circuit" will be simply referred to as "pixels" in some cases.

As shown in FIG. 1, an organic EL display apparatus 10 according to the embodiment of the present disclosure includes a pixel array unit 30 in which a plurality of pixels 20 including the organic EL elements are arranged in a two-dimensional matrix form and a peripheral drive unit (drive circuit unit) is arranged in the periphery of the pixel array unit 30. The peripheral drive unit is configured of a writing and scanning unit 40, a selector circuit unit 50, a drive scanning unit 60, a signal output unit 70, and the like mounted on the same display panel 80 as that of the pixel array unit 30, and drives the respective pixels 20 in the pixel array unit 30. In addition, it is also possible to employ another configuration in which a part or an entirety of the writing and scanning unit 40, the selector circuit unit 50, the drive scanning unit 60, and the signal output unit 70 is provided outside the display panel 80.

Here, if the organic EL display apparatus 10 is adapted to perform color display, a pixel (unit pixel) as a unit of forming a color image is configured of a plurality of sub pixels. At this time, each of the sub pixels corresponds to the pixel 20 in FIG. 1. More specifically, according to the display apparatus adapted to perform color display, a pixel is configured of three sub pixels, namely a sub pixel including a light emitting unit for emitting red (R) light, a sub pixel including a light emitting unit for emitting green (G) light, and a sub pixel including a light emitting unit for emitting blue (B) light.

However, a pixel is not limited to the combination of the sub pixels of three primary colors R, G, and B, and it is also possible to configure a pixel by further adding one or more sub pixels to the sub pixels of the three primary colors. More specifically, it is also possible to configure a pixel by adding a sub pixel including a light emitting unit for emitting white (W) light in order to enhance illuminance or to configure a pixel by adding at least one sub pixel including a light emitting unit which emits complementary color light in order to expand a range of color reproduction, for example.

In the pixel array unit 30 in which the pixels 20 are aligned in m rows and n columns, scanning lines 31 ($\mathbf{31}_1$ to $\mathbf{31}_m$) and power supply lines 32 ($\mathbf{32}_1$ to $\mathbf{32}_m$) are arranged in the row direction (a direction along the pixel rows; horizontal direction) so as to correspond to the respective pixel rows. Furthermore, with respect to the alignment of the pixels 20 in m rows and n columns, signal lines 33 ($\mathbf{33}_1$ to $\mathbf{33}_n$) are arranged along the column direction (a direction along the pixel column; vertical direction) so as to correspond to the respective pixel columns.

The scanning lines $\mathbf{31}_1$ to $\mathbf{31}_m$ are respectively connected to output terminals of corresponding rows in the selector circuit unit 50. The power supply lines $\mathbf{32}_1$ to $\mathbf{32}_m$ are respectively connected to output terminals of corresponding rows in the drive scanning unit 60. The signal lines $\mathbf{33}_1$ to $\mathbf{33}_n$ are respectively connected to output terminals of corresponding columns in the signal output unit 70.

The writing and scanning unit 40 is configured of a shift resistor circuit, for example. In a case in which a plurality of pixel rows in the pixel array unit 30 is assumed to be a unit, the writing and scanning unit 40 outputs, in a time-series manner, a plurality of writing and scanning signals WS ($WS_1$ to $WS_m$) corresponding to a unit of a plurality of pixel rows when a signal voltage of a video signal is written in each pixel 20 in the pixel array unit 30. Here, two pixel rows are assumed to be a unit, for example.

The writing and scanning signals WS ($WS_1$ to $WS_m$) which are output from the writing and scanning unit 40 in the time-series manner are input to the selector circuit unit 50. The selector circuit unit 50 selects, in turn, the scanning signals WS ($WS_1$ to $WS_m$) for writing signals, which are input in the time-series manner, and allocates the selected scanning signals to the respective scanning lines 31 ($31_1$ to $\mathbf{31}_m$) in a unit of the plurality of pixel rows (two pixel rows in this example). In doing so, so-called line sequential scanning in which the respective pixels 20 in the pixel array unit 30 are scanned in turn in units of rows is performed.

It is possible to achieve a decrease (downsize) of a circuit scale of the writing and scanning unit 40 by employing a configuration in which the writing and scanning unit 40 outputs, in series, the plurality of scanning signals WS for writing signals and the selector circuit unit 50 allocates the scanning signals WS for writing signals to the scanning lines 31 of the corresponding pixel rows as described above. Specifically, if two pixel rows are handled as a unit, the number of output stages (unit circuits) in the writing and scanning unit 40 can be reduced to a half of the number of rows in the pixel array unit 30. Therefore, it is possible to achieve a decrease in circuit scale into a half of the circuit scale in a case in which a pixel row is handled as a unit, that is, in a case where it is necessary to provide the output stages as much as the number of pixel rows.

It is possible to achieve a decrease in circuit scale of the writing and scanning unit 40 and to thereby achieve a decrease in cost of the display panel 80 in a case of employing the configuration in which the writing and scanning unit 40 is mounted on the display panel 80. In addition, it is possible to contribute to narrowing of a frame of the display panel 80, that is, a decrease in size of a region where the peripheral drive unit including the writing and scanning unit 40 is formed. For this reason, the aforementioned technique, namely the technique of causing the writing and scanning unit 40 to output the plurality of scanning signals WS for writing signals in the time-series manner and causing the selector circuit unit 50 to allocate the scanning signals WS for writing signals to the scanning lines 31 of the corresponding pixel rows is a useful technique particularly in a case in which the number of output stages (unit circuits) of the writing and scanning unit 40 increases due to an increase in pixels for high-definition display of the display panel 80.

The drive scanning unit 60 is configured of a shift resistor circuit, for example, in the same manner as the writing and scanning unit 40. The drive scanning unit 60 supplies, to the power supply lines 32 ($\mathbf{32}_1$ to $\mathbf{32}_m$), power voltages DS ($DS_1$ to $DS_m$) which can be switched between a first power voltage $V_{cc_H}$ and a second power voltage $V_{cc_L}$ that is lower than the first power voltage $V_{cc_H}$ in a synchronized manner with the line sequential scanning by the writing and scanning unit 40. As will be described later, light emission and non-emission (extinction) of the pixels 20 are controlled by the drive scanning unit 60 switching the power voltages DS between $V_{cc_H}$ and $V_{cc_L}$.

The signal output unit 70 selectively outputs a signal voltage $V_{sig}$ of video signals in accordance with illuminance information which is supplied from a signal supply source (not shown) (hereinafter, simply referred to as "signal voltage" in some cases) and a reference voltage $V_{ofs}$. Here, the reference voltage $V_{ofs}$ is a voltage (a voltage corresponding to a black level of the video signal, for example) used as a reference of the signal voltage $V_{sig}$ of the video signals and is used for threshold value correction processing which will be described later.

When the signal voltage $V_{sig}$ is output, the signal output unit 70 outputs, in the time-series manner, the signal voltage $V_{sig}$ of a plurality of video signals corresponding to a unit of the plurality of pixel rows to the signal lines 33 ($\mathbf{33}_1$ to $\mathbf{33}_n$) in a plurality of horizontal periods corresponding to the number of rows in a unit. Since two pixel rows are handled as a unit in this example, the signal output unit 70 outputs, in the time-series manner, the signal voltage $V_{sig}$ of two video signals corresponding two pixel rows.

The signal voltage $V_{sig}$ and the reference voltage $V_{ofs}$ output from the signal output unit 70 are written in the respective pixels 20 in the pixel array unit 30 via the signal lines 33 ($\mathbf{33}_1$ to $\mathbf{33}_n$) in units of pixel rows selected by the scanning performed by the writing and scanning unit 40 and the selector circuit unit 50. That is, the signal output unit 70 employs a drive form of the line sequential writing in which the signal voltage $V_{sig}$ is written in units of rows (lines).

Pixel Circuit

Figure 2:
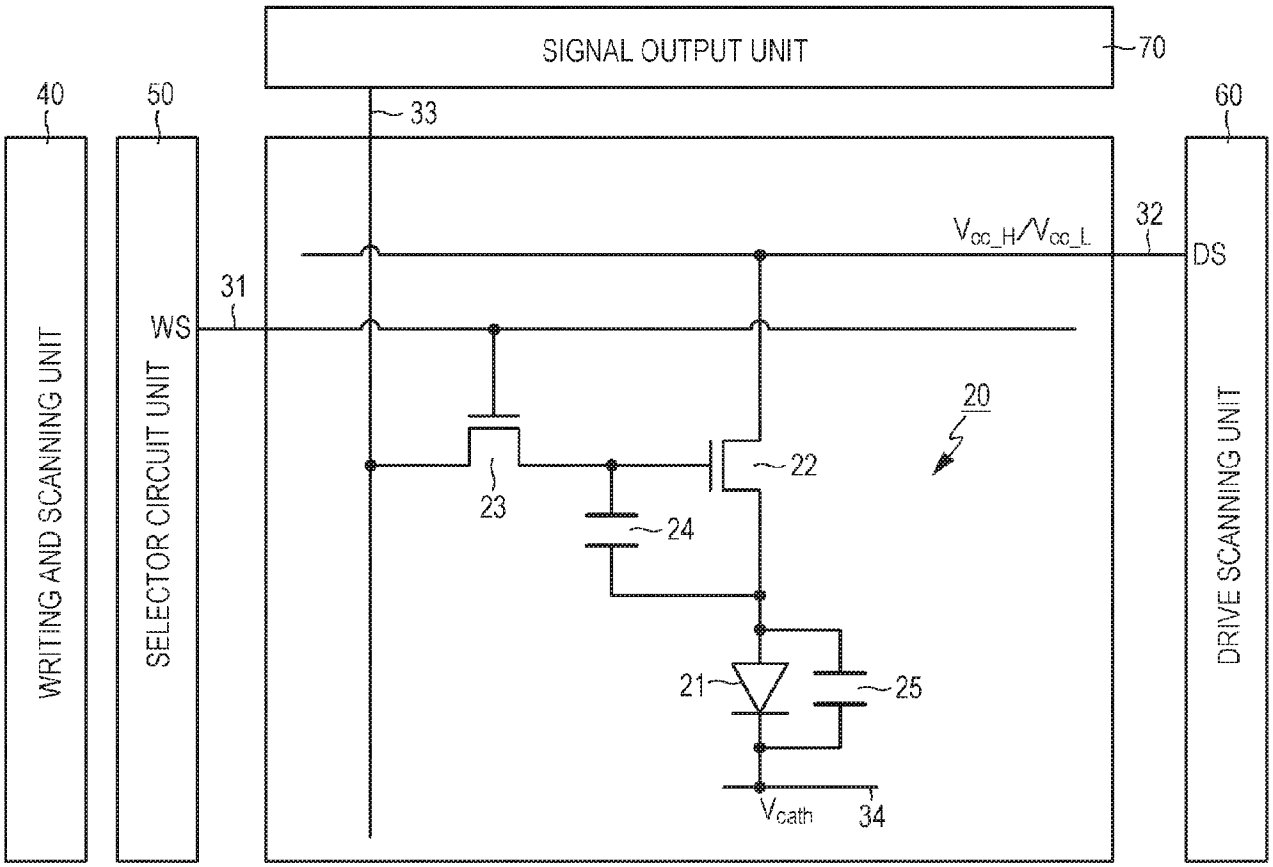
FIG. 2 is a circuit diagram illustrating a circuit configuration of pixels (pixel circuit) in a specific example.

FIG. 2 is a circuit diagram showing a circuit configuration of pixels (pixel circuit) 20 in a specific example. The light emitting units of the pixels 20 are configured of organic EL elements 21. The organic EL elements 21 are an example of electro-optical elements of a current drive type, which emit light with luminance varying in accordance with a value of a current flowing through the device.

As shown in FIG. 2, each pixel 20 is configured of an organic EL element 21 and a drive circuit which drives the organic EL element 21 by causing a current to flow through the organic EL element 21. A cathode electrode of the organic EL element 21 is connected to a common power source line 34 which is arranged commonly to all the pixels 20.

The drive circuit which drives the organic EL element 21 has a configuration including a drive transistor 22, a writing transistor 23, a retention capacitance 24, and an auxiliary capacitance 25, that is, a circuit configuration of 2Tr2C configured of two transistors (Tr) and two capacitance parts (C). As the drive transistor 22 and the writing transistor 23, it is possible to use N-channel-type TFTs. However, the conductive-type combination of the drive transistor 22 and the writing transistor 23 is exemplified herein only for illustrative purposes, and the present disclosure is not limited to the combination. That is, it is also possible to use P-channel-type TFTs as the drive transistor 22 and the writing transistor 23, or to employ a combination of an N-channel-type TFT and a P-channel-type TFT.

One electrode (a source electrode or a drain electrode) of the drive transistor 22 is connected to an anode electrode of the organic EL element 21, and the other electrode (the source electrode or the drain electrode) thereof is connected to a power supply line 32 ($\mathbf{32}_1$ to $\mathbf{32}_m$). One electrode (a source electrode or a drain electrode) of the writing transistor 23 is connected to a signal line 33 ($\mathbf{33}_1$ to $\mathbf{33}_n$), and the other electrode (the source electrode or the drain electrode) thereof is connected to a gate electrode of the drive transistor 22. In addition, a gate electrode of the writing transistor 23 is connected to the scanning line 31 ($\mathbf{31}_1$ to $\mathbf{31}_m$).

One electrode of each of the drive transistor 22 and the writing transistor 23 represents metal wiring electrically connected to one of source and drain regions, and the other electrode of each of the drive transistor 22 and the writing transistor 23 represents metal wiring electrically connected to the other one of the source and drain regions. One electrode may be a source electrode or a drain electrode, and the other electrode may be a drain electrode or a source electrode, depending on a potential relationship between one electrode and the other electrode.

One electrode of the retention capacitance 24 is connected to the gate electrode of the drive transistor 22, and the other electrode of the retention capacitance 24 is connected to the other electrode of the drive transistor 22 and the anode electrode of the organic EL element 21. One electrode of the auxiliary capacitance 25 is connected to the anode electrode of the organic EL element 21, and the other electrode of the auxiliary capacitance 25 is connected to the common power source line 34. Although it is assumed herein that the other electrode of the auxiliary capacitance 25 is connected to the common power source line 34, the connection target of the other electrode is not limited to the common power source line 34, and may be connected to any node with a fixed potential.

The auxiliary capacitance 25 is provided, as necessary, in order to complement a shortage of capacitance in the organic EL element 21 and to enhance a video signal writing gain of the retention capacitance 24. That is, the auxiliary capacitance 25 is not necessarily provided in the pixel 20 and can be omitted in a case in which equivalent capacity of the organic EL element 21 is sufficiently large.

In the pixel 20 with the aforementioned configuration, the writing transistor 23 is brought into a conductive state in response to a writing and scanning signal WS, which is applied from the selector circuit unit 50 to the gate electrode via the scanning line 31, and a high voltage state of which corresponds to an active state. In doing so, the writing transistor 23 samples the signal voltage $V_{sig}$ of the video signals in accordance with the luminance information or the reference voltage $V_{ofs}$, which is supplied at a different timing from the signal output unit 70 through the signal line 33, and writes the sampled signal voltage $V_{sig}$ or reference voltage $V_{ofs}$ in the pixel 20. The signal voltage $V_{sig}$ or the reference voltage $V_{ofs}$ written by the writing transistor 23 is held in the retention capacitance 24.

When the power voltage DS of the power supply line 32 ($\mathbf{32}_1$ to $\mathbf{32}_m$) is the first power voltage $v_{cc_H}$, the drive transistor 22 operates in a saturated region while one electrode thereof functions as a drain electrode and the other electrode functions as a source electrode. In doing so, the drive transistor 22 receives current supplied from the power supply line 32 and drives, with the current, the organic EL element 21 to emit light. More specifically, the drive transistor 22 supplies a drive current of a current value in accordance with a voltage value of the signal voltage $V_{sig}$ held in the retention capacitance 24 to the organic EL element 21 by operating in the saturated region and drives, with the current, the organic EL element 21 to emit light.

Furthermore, when the power voltage DS is switched from the first power voltage $V_{cc_H}$ to the second power voltage $V_{cc_L}$, the drive transistor 22 operates as a switching transistor while one electrode thereof functions as a source electrode and the other electrode functions as a drain electrode. In doing so, the drive transistor 22 stops the supply of the drive current to the organic EL element 21 and brings the organic EL element 21 into a non-emission state (extinction state). That is, the drive transistor 22 also has a function of a transistor controlling light emission and non-emission of the organic EL element 21 based on the switching of the power voltage DS ($V_{cc_H}$ or $V_{cc_L}$).

By the switching operation of the drive transistor 22, it is possible to provide a period (non-emission period) during which the organic EL element 21 is in the non-emission state and to control a ratio (duty) of the light emission period and the non-emission period of the organic EL element 21. Since residual image blur which is caused by light emission of the pixel continued for a display frame period can be reduced by the duty control, it is possible to achieve particularly high video image quality.

In the first and second power voltages $V_{cc_H}$ and $V_{cc_L}$ selectively supplied from the drive scanning unit 60 through the power supply line 32, the first power voltage $V_{OCH}$ is a power voltage for supplying a drive current, which is for driving the organic EL element 21 to emit light, to the drive transistor 22. In addition, the second power voltage $V_{cc_L}$ is a power voltage for applying a reverse bias to the organic EL element 21. The second power voltage $V_{cc_L}$ is set to a voltage which is lower than the reference voltage $V_{ofs}$, for example, a voltage which is lower than $V_{ofs}-V_{th}$, where $V_{th}$ represents a threshold voltage of the drive transistor 22, and preferably a voltage which is sufficiently lower than $V_{ofs}-V_{th}$.

Basic Circuit Operations

Next, a description will be given of basic circuit operations of the organic EL display apparatus 10 with the aforementioned configuration with reference to the timing waveform diagram in FIG. 3.

Figure 3:
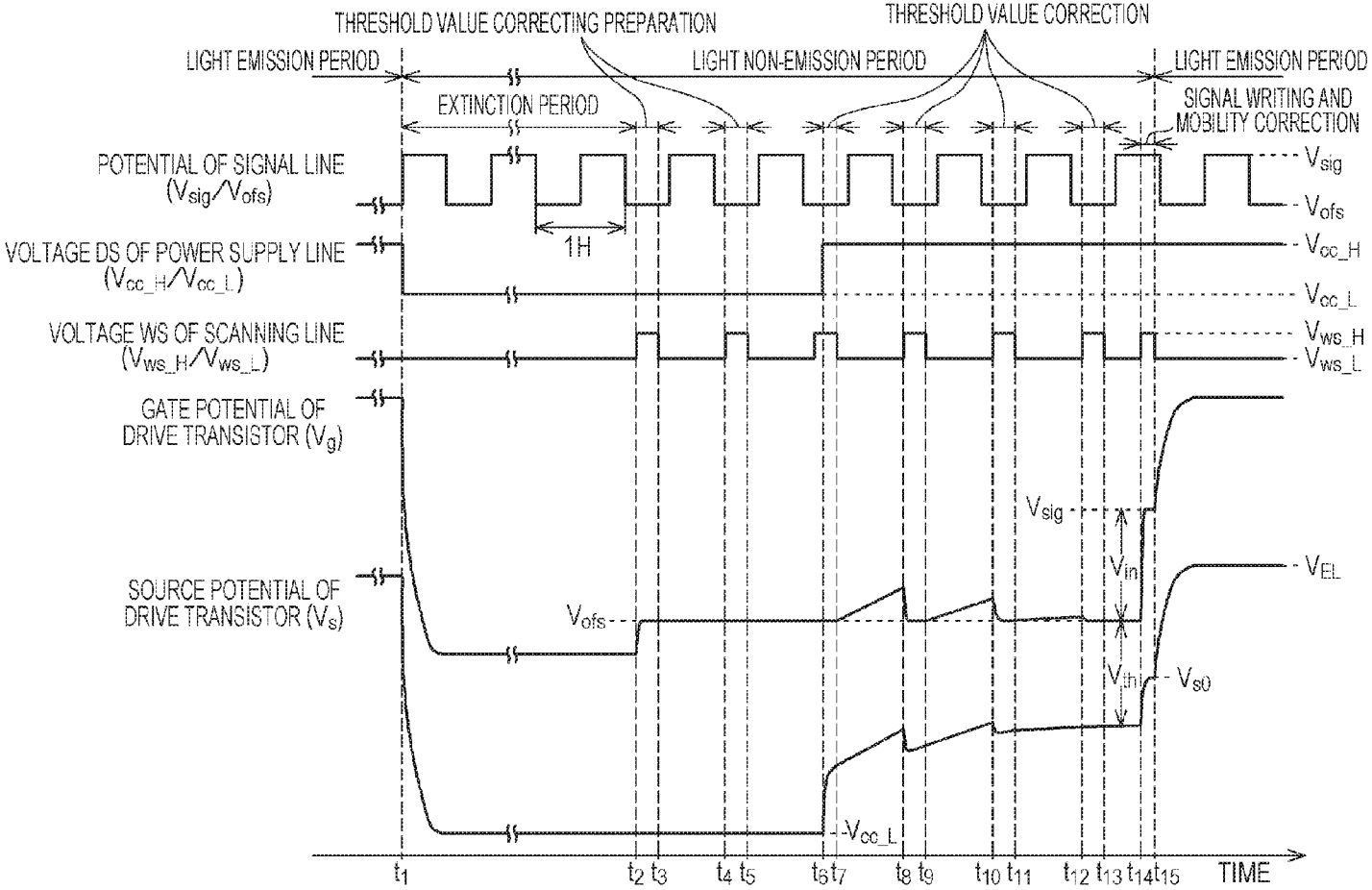
FIG. 3 is a timing waveform diagram illustrating basic circuit operations of an active matrix-type organic EL display apparatus according to an embodiment of the present disclosure.

The timing waveform diagram in FIG. 3 shows variations in the voltage (writing and scanning signal) WS of the scanning line 31, the voltage (power voltage) DS of the power supply line 32, the voltages ($V_{sig}$ and $V_{ofs}$) of the signal line 33, and a gate voltage $V_g$ and a source voltage $V_s$ of the drive transistor 22. Here, a cycle at which the voltage of the signal line 33 is switched, namely a cycle at which the signal voltage $V_{sig}$ and the reference voltage $V_{ofs}$ of the video signal are switched corresponds to a horizontal period (1H).

Since the writing transistor 23 is an N-channel type transistor, a high voltage state of the writing and scanning signal WS corresponds to an active state, and the low voltage state thereof corresponds to a non-active state. In addition, the writing transistor 23 is brought into the conductive state when the writing and scanning signal WS is in the active state, and is brought into the non-conductive state when the writing and scanning signal WS is in the non-active state.

Light Emission Period of Display Frame

In the timing waveform diagram in FIG. 3, the period before time $t_1$ is the light emission period of the organic EL element 21 in a previous display frame. During the light emission period in this previous display frame, the voltage DS of the power supply line 32 is the first power voltage (hereinafter, referred to as a "high voltage") $V_{cc_H}$, and the writing transistor 23 is in the non-conductive state.

At this time, the drive transistor 22 is set so as to operate in the saturated region. In doing so, a drive current (a current between the drain and the source) $I_{ds}$ in accordance with a voltage $V_g$, between the gate and the source of the drive transistor 22 is supplied from the power supply line 32 to the organic EL element 21 through the drive transistor 22. Therefore, the organic EL element 21 emits light with illuminance in accordance with a current value of the drive current $I_{ds}$.

The drive current (the current between the drain and the source of the drive transistor 22) $I_{ds}$ supplied to the organic EL element 21 is obtained by the following Equation (1).

$$I_{ds}=(1/2)\cdot u(W/L)C_{ox}(V_{gs}-V_{th})^2 \quad (1)$$

Here, u represents mobility of a semiconductor thin film which configures a channel of the drive transistor 22, W represents a channel width of the drive transistor 22, L represents a channel length of the drive transistor 22, and $C_{ox}$ represents a gate capacity of the drive transistor 22 per unit area.

Extinction Period

A non-emission period in a new display frame (current display frame) of the line sequential scanning starts at the time $t_1$. Then, the voltage DS of the power supply line 32 is switched from the high voltage $V_{cc_H}$ to the second power voltage (hereinafter, referred to as a "low voltage") $V_{cc_L}$ at the time $t_1$.

Here, it is assumed that the threshold voltage of the organic EL element 21 is $V_{th_EL}$ and the voltage (cathode voltage) of the common power source line 34 is $V_{cath}$. At this time, if the low voltage $V_{cc_L}$ satisfies $V_{cc_L}<V_{th_EL}+V_{cath}$, the organic EL element 21 is brought into the inversely biased state and stops the light emission. In addition, a source or drain region of the drive transistor 22 on the side of the power supply line 32 becomes a source region, and the source or drain region on the side of the organic EL element 21 becomes a drain region. At this time, the anode electrode of the organic EL element 21 is charged to have the low voltage $V_{cc_L}$.

Threshold Value Correction Preparation Period

Next, if the voltage WS of the scanning line 31 shifts from a low voltage $V_{ws_L}$ to a high voltage $V_{ws_H}$ at time $t_2$ in a state in which the reference voltage $V_{ofs}$ is supplied to the signal line 33, the writing transistor 23 is brought into the conduct state and samples the reference voltage $V_{ofs}$. In doing so, the gate voltage $V_g$ of the drive transistor 22 becomes the reference voltage $V_{ofs}$. In addition, the source voltage $V_s$ of the drive transistor 22 is a voltage which is sufficiently lower than the reference voltage $V_{ofs}$, that is, the low voltage $V_{cc_L}$.

At this time, the voltage $V_{gs}$ between the gate and the source of the drive transistor 22 becomes $V_{ofs}-V_{cc_L}$. Here, it is necessary to set such a voltage relationship to satisfy $V_{ofs}-V_{cc_L}>V_{th}$ since the threshold value correction processing (threshold value correcting operation) which will be described later is not available if $V_{ofs}-V_{cc_L}$ is not greater than the threshold voltage $V_{th}$ of the drive transistor 22.

The processing of setting the gate voltage $V_g$ of the drive transistor 22 to the reference voltage $V_{ofs}$ and setting (fixing) and initializing the source voltage $V_s$ to the low voltage $V_{cc_L}$ as described above is preparation (threshold value correction preparation) processing in a previous stage performed before the threshold value correction processing which will be described later. Therefore, the reference voltage $V_{ofs}$ and the low voltage $V_{cc_L}$ become the initialization voltages of the gate voltage $V_g$ and the source voltage $V_s$ of the drive transistor 22, respectively.

As described above, the first operation of the threshold value correction preparation is performed during the period from the time $t_2$ to the time $t_3$, in which the voltage WS of the scanning line 31 becomes the high voltage $V_{ws_H}$. Then, the second operation of the threshold value correction preparation is performed in a period from time $t_4$ to time $t_5$ in a subsequent horizontal period, in the same manner as the first operation of the threshold value correction preparation.

Threshold Value Correction Period

Next, in a period during which the voltage of the signal line 33 becomes the reference voltage $V_{ofs}$ and the voltage WS of the scanning line 31 becomes the high voltage $V_{ws_H}$, the voltage DS of the power supply line 32 is switched from the low voltage $V_{cc_L}$ to the high voltage $V_{cc_H}$ at time $t_6$. In doing so, the source or drain region of the drive transistor 22 on the side of the power supply line 32 becomes the drain region, the source or drain region on the side of the organic EL element 21 becomes a source region, and a current flows through the drive transistor 22.

An equivalent circuit of the organic EL element 21 is represented by a diode and an equivalent capacitance. Therefore, the current flowing through the drive transistor 22 is used to charge the retention capacitance 24, the auxiliary capacitance 25, and the equivalent capacitance of the organic EL element 21 as long as the source voltage $V_s$ of the drive transistor 22 satisfies $V_s \leq V_{th_EL}+V_{cath}$ (a leakage current of the organic EL element 21 is sufficiently smaller than the current flowing through the drive transistor 22). At this time, the source voltage $V_s$ of the drive transistor 22 increases with time.

The writing transistor 23 is brought into the non-conductive state in accordance with the voltage WS of the scanning line 31 shifting from the high voltage $V_{ws_H}$ to the low voltage $V_{cc_L}$ at time $t_7$ after elapse of predetermined time. At this time, the voltage $V_{gs}$ between the gate and the source of the drive transistor 22 is greater than the threshold voltage $V_{th}$, and therefore, the current flows through the drive transistor 22. In doing so, both the gate voltage $V_g$ and the source voltage $V_s$ of the drive transistor 22 increase.

The processing (operation) of causing the source voltage $V_s$ to vary toward the voltage obtained by subtracting the threshold voltage $V_{th}$ of the drive transistor 22 from the initialization voltage $V_{ofs}$ of the gate voltage $V_g$ of the drive transistor 22 as described above is the threshold value correction processing (operation). At this time, no light is emitted as long as $V_s \leq V_{th_EL}+V_{cath}$ is satisfied since organic EL element 21 is inversely biased.

The second threshold value correction processing is started in accordance with the voltage WS of the scanning line 31 shifting to the high voltage $V_{ws_H}$ again and the writing transistor 23 being brought into the conductive state at time $t_8$ in the next horizontal period during which the voltage of the signal line 33 becomes the reference voltage $V_{ofs}$ again. The second threshold value correction processing is performed until time $t_9$ at which the voltage WS of the scanning line 31 shifts to the low voltage $V_{ws_L}$.

By repeating the aforementioned operations, the voltage $V_{gs}$ between the gate and the source of the drive transistor 22 is eventually converged to the threshold voltage $V_{th}$ of the drive transistor 22. The voltage corresponding to the threshold voltage $V_{th}$ is held by the retention capacitance 24. At this time, $V_s=V_{ofs}-V_{th} \leq V_{th_EL}+V_{cath}$ is satisfied.

Divided Threshold Value Correction

In this example, the drive method of performing so-called divided threshold value correction of dividing the threshold value correction processing and executing the processing a plurality of times is employed. Here, the "divided threshold value correction" is a drive method of dividing the threshold value correction and executing the threshold value correction a plurality of times in a plurality of horizontal periods prior to a horizontal period, during which the threshold value correction processing is performed along with signal writing and mobility correction processing as will be described later, in addition to the horizontal period.

According to the drive method based on the divided threshold value correction, it is possible to secure sufficient time in the plurality of horizontal periods as a threshold value correction period even if time which can be allocated to one horizontal period is shortened due to an increase in the number of pixels for high-definition display, that is, even if a frame rate increases. Therefore, since it is possible to secure sufficient time as the threshold value correction period even if the time which can be allocated to one horizontal period is shortened, and to thereby reliably execute the threshold value correction processing.

In this example, the threshold value correction processing is further performed twice in addition to the aforementioned first threshold value correction processing and the second threshold value correction processing, that is, a total of four times based on the drive method based on the divided threshold value correction. That is, the third threshold value correction processing and the fourth threshold value correction processing are sequentially performed in synchronization with the timing at which the voltage WS of the scanning line 31 shifts from the low voltage $V_{cc_L}$ to the high voltage $V_{ws_H}$ in the two horizontal periods following the second horizontal period. Specifically, the third threshold value correction processing is performed in a period from time $t_{10}$ to time $t_{11}$, and the fourth threshold value correction processing is performed in a period from $t_{12}$ to $t_{13}$.

Although the drive method based on the divided threshold value correction, in which the threshold value correction processing is performed four times, is employed herein, the number of times the divided threshold value correction is performed is not limited to four, and may be two, three, five, or more. In relation to the threshold value correction processing, the present disclosure is not limited to the employment of the drive method based on the divided threshold value correction, and it is a matter of course that a drive method of executing the threshold value correction processing only once may be employed as long as it is possible to secure sufficient time as the threshold value correction time.

Signal Wiring and Mobility Correction Period

After the fourth threshold value correction processing is completed, the signal writing and mobility correction processing is performed in accordance with the voltage of the signal line 33 shifting from the reference voltage $V_{ofs}$ to the signal voltage $V_{sig}$ of the video signal in the same horizontal period. That is, the writing transistor 23 is brought into the conductive state, samples the signal voltage $V_{sig}$, and writes the signal voltage $V_{sig}$ in the pixel 20 in accordance with the voltage WS of the scanning line 31 shifting from the low voltage $V_{cc_L}$ to the high voltage $V_{ws_H}$ at time $t_{14}$ in a period during which the signal voltage $V_{sig}$ of the video signal is supplied to the signal line 33.

The gate voltage $V_g$ of the drive transistor 22 becomes the signal voltage $V_{sig}$ in accordance with the writing transistor 23 writing the signal voltage $V_{sig}$. Then, the threshold value correction processing is eventually performed by offsetting the threshold voltage $V_{th}$ of the drive transistor 22 with the voltage corresponding to the threshold voltage $V_{th}$ held by the retention capacitance 24 when the drive transistor 22 performs driving with the signal voltage $V_{sig}$ of the video signal.

In addition, the source voltage $V_s$ of the drive transistor 22 increases with time as shown in the timing waveform diagram in FIG. 3. If the source voltage $V_s$ of the drive transistor 22 does not exceed a sum of the threshold voltage $V_{th_EL}$ of the organic EL element 21 and the cathode voltage $V_{cath}$, that is, if the leakage current of the organic EL element 21 is sufficiently smaller than the current flowing through the drive transistor 22, the current flowing through the drive transistor 22 flows into the retention capacitance 24, the auxiliary capacitance 25, and the equivalent capacitance of the organic EL element 21. In doing so, charging of the retention capacitance 24, the auxiliary capacitance 25, and the equivalent capacitance of the organic EL element 21 is started.

As the retention capacitance 24, the auxiliary capacitance 25, and the equivalent capacitance of the organic EL element 21 are charged, the source voltage $V_s$ of the drive transistor 22 increases with time. Since the correction processing (correcting operation) of the threshold voltage $V_{th}$ of the drive transistor 22 has already been completed, the current $I_{ds}$ between the drain and the source of the drive transistor 22 depends on mobility u of the drive transistor 22.

Here, it is assumed that a ratio of the retention voltage $V_{gs}$ held by the retention capacitance 24 with respect to the signal voltage $V_{sig}$ of the video signal, that is, a writing gain G is one (ideal value). Then, the voltage $V_{gs}$ between the gate and the source of the drive transistor 22 becomes $V_{sig}-V_{ofs}+V_{th}-\Delta V_s$ in accordance with the source voltage $V_s$ of the drive transistor 22 increasing to the voltage represented as $V_{ofs}-V_{th}+\Delta V_s$.

That is, the increase $\Delta V_s$ of the source voltage $V_s$ of the drive transistor 22 acts so as to be subtracted from the voltage $(V_{sig}-V_{ofs}+V_{th})$ held by the retention capacitance 24, that is, so as to discharge the electrical charge from the retention capacitance 24. In other words, the increase $\Delta V_s$ of the source voltage $V_s$ applies negative feedback to the retention capacitance 24. Therefore, the increase $\Delta V_s$ of the source voltage $V_s$ corresponds to the amount of negative feedback.

By applying the negative feedback of the amount $\Delta V_s$ in accordance with the current $I_{ds}$ between the drain and the source, which flows through the drive transistor 22, to the voltage $V_{gs}$ between the gate and the source as described above, it is possible to cancel the dependency of the current $I_{ds}$ between the source and the drain of the drive transistor 22 on the mobility U. The processing of canceling the dependency corresponds to the mobility correction processing (operation) for correcting variations in mobility u of the drive transistor 22 for each pixel.

More specifically, the current $I_{ds}$ between the drain and the source increases as a signal amplitude $V_{in}$ $(=V_{sig}-V_{ofs})$ of the video signal written in the gate electrode of the drive transistor 22 is higher, and therefore, an absolute value of the amount $\Delta V_s$ of the negative feedback also increases. For this reason, the mobility correction processing in accordance with an emitted light illuminance level is performed.

If it is assumed that the signal amplitude $V_{in}$ of the video signal is constant, the absolute value of the amount $\Delta V_s$ of the negative feedback increases as the mobility u of the drive transistor 22 increases, and therefore, it is possible to remove variations in the mobility u of each pixel. For this reason, the amount $\Delta V_s$ of the negative feedback can also be referred to as a correction amount in the mobility correction processing.

Specifically, the current amount at the drive transistor 22 with large mobility u is large, and the source voltage $V_s$ quickly increases. In contrast, the current amount at the drive transistor 22 with small mobility u is small, and the source voltage $V_s$ slowly increases. Therefore, the source voltage $V_s$ of the drive transistor 22 increases after the writing transistor 23 is brought into the conductive state, and becomes a voltage $V_{s0}$ which reflects the mobility u when the writing transistor 23 is brought into the non-conductive state. The voltage $V_{ds}$ between the drain and the source of the drive transistor 22 becomes $V_{sig}-V_{s0}$ and corresponds to a voltage of correcting the mobility u.

Light Emission Period

The writing transistor 23 is brought into the non-conductive state, and the signal writing and the mobility correction processing are completed, in accordance with the voltage WS of the scanning line 31 shifting from the high voltage $V_{ws_H}$ to the low voltage $V_{cc_L}$ at time $t_{15}$. In addition, the gate electrode of the drive transistor 22 is electrically disconnected from the signal line 33 and is brought into a floating state in accordance with the writing transistor 23 being brought into the non-conductive state.

Here, if the gate electrode of the drive transistor 22 is in the floating state, the gate voltage $V_g$ also varies in conjunction with the variations in the source voltage $V_s$ of the drive transistor 22 since the retention capacitance 24 is connected between the gate and the source of the drive transistor 22. Therefore, the voltage $V_{ds}$ between the drain and the source of the drive transistor 22 is maintained to be constant.

The operation of the gate voltage $V_g$ of the drive transistor 22 varying in conjunction with the variations in the source voltage $V_s$ is a bootstrap operation. In other words, the operation of causing the gate voltage $V_g$ and the source voltage $V_s$ to increase while maintaining the voltage $V_{ds}$ between the gate and the source, which is held by the retention capacitance 24, to be constant is the bootstrap operation.

The anode voltage of the organic EL element 21 increases in accordance with the current $I_{ds}$ in response to the gate electrode of the drive transistor 22 being brought into the floating state and the current $I_{ds}$ between the drain and the source of the drive transistor 22 starting to flow through the organic EL element 21 at the same time.

Then, if the anode voltage of the organic EL element 21 exceeds $V_{th_EL}+V_{cath}$, a drive current starts to flow through the organic EL element 21, and therefore, the organic EL element 21 starts light emission. In addition, the increase in the anode voltage of the organic EL element 21 also means an increase in the source voltage $V_s$ of the drive transistor 22. If the source voltage $V_s$ of the drive transistor 22 increases, the gate voltage $V_g$ of the drive transistor 22 also increases in conjunction with the increase in the source voltage $V_s$ due to the bootstrap operation accompanying the retention capacitance 24.

If it is assumed that a bootstrap gain is one (ideal value) at this time, the amount of increase in the gate voltage $V_g$ of the drive transistor 22 becomes equal to the amount of increase in the source voltage $V_s$. Therefore, the voltage $V_{ds}$ between the gate and the source of the drive transistor 22 is constantly maintained to $V_{sig}-V_{ofs}+V_{th}-\Delta V_s$ during the light emission period.

Selector Circuit Unit According to Reference Example

Figure 4:
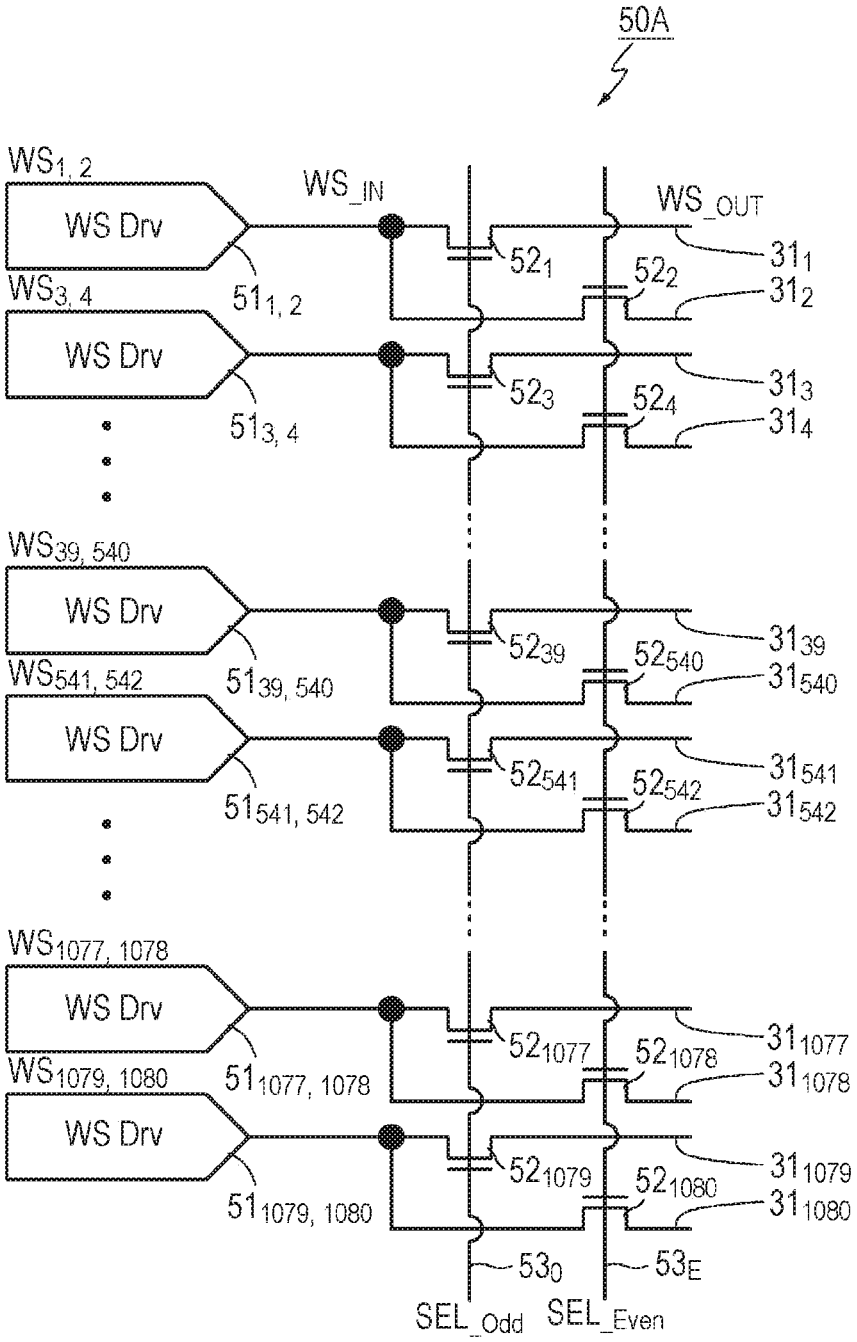
FIG. 4 is a circuit diagram illustrating a circuit configuration of a selector circuit unit according to a reference example.

Here, a selector circuit unit 50 before applying the technique according to the present disclosure is applied will be described as a selector circuit unit 50A according to a reference example. FIG. 4 is a circuit diagram illustrating a circuit configuration of the selector circuit unit 50A according to the reference example. Here, a case in which the number of pixel rows (the number of horizontal lines) in the pixel array unit 30 is 1080 (Full high-definition (HD) television; image resolution is 1920 pixels×1080 pixels) will be described as an example.

As shown in FIG. 4, the selector circuit unit 50A according to the reference example includes input terminals $\mathbf{51}_{1,2}$ to $\mathbf{51}_{1079,1080}$, the number of which is ½ of the number of horizontal lines. Here, the input terminal $\mathbf{51}_{1,2}$ corresponds to scanning lines $\mathbf{31}_1$ and $\mathbf{31}_2$ of the first and second pixel rows in the pixel array unit 30, and thereafter, each unit of two pixel rows corresponds to each scanning line 31 in turn, and the input terminal $\mathbf{51}_{1079,1080}$ corresponds to scanning lines $\mathbf{31}_{1079}$ and $\mathbf{31}_{1080}$ of the 1079th and 1080th pixel rows.

The selector circuit unit 50A is configured of two transistors (hereinafter, referred to as a "selection transistor") for each input terminal 51 ($\mathbf{51}_{1,2}$ to $\mathbf{51}_{1079,1080}$), and for example, N-channel-type TFTs of transparent oxide semiconductors (TOS). Specifically, two selection transistors $\mathbf{52}_1$ and $\mathbf{52}_2$ are connected between the input terminal $\mathbf{51}_{1,2}$ and the scanning lines $\mathbf{31}_1$ and $\mathbf{31}_2$ of the first and second pixel rows, and two selection transistors $\mathbf{52}_3$ and $\mathbf{52}_4$ are connected between the input terminal $\mathbf{51}_{3,4}$ and the scanning lines $\mathbf{31}_3$ and $\mathbf{31}_4$ of the third and fourth pixel rows. In the same manner, two selection transistors 52 are provided for each input terminal 51 in turn, and two selection transistors $\mathbf{52}_{1079}$ and $\mathbf{52}_{1080}$ are connected between the input terminal $\mathbf{51}_{1079,1080}$ and the scanning lines $\mathbf{31}_{1079}$ and $\mathbf{31}_{1080}$ of the 1079th and 1080th pixel rows.

Among the selection transistors $\mathbf{52}_1$ to $\mathbf{52}_{1080}$ (hereinafter, also referred to as "selection transistors 52" as a representative thereof in some cases), selection lines $\mathbf{53}_O$ are arranged for the selection transistors $\mathbf{52}_1, \mathbf{52}_3, \ldots, \mathbf{52}_{1079}$ corresponding to the odd pixel rows, and selection lines $\mathbf{53}_E$ are arranged for the selection transistors $\mathbf{52}_2, \mathbf{52}_4, \ldots, \mathbf{52}_{1080}$ corresponding to the even pixel rows. Each selection line $\mathbf{53}_O$ is connected to each gate electrode of each of the selection transistors $\mathbf{52}_1, \mathbf{52}_3, \ldots, \mathbf{52}_{1079}$ corresponding to the odd pixel rows, and each selection line $\mathbf{53}_E$ is connected to each gate electrode of each of the selection transistors $\mathbf{52}_2, \mathbf{52}_4, \ldots, \mathbf{52}_{1080}$ corresponding to the even pixel rows. In addition, a selection signal (selection pulse) $SEL_{Odd}$ for the odd rows is provided to each selection line $\mathbf{53}_O$, and a selection signal $SEL_{Even}$ for the even rows is provided to each selection line $\mathbf{53}_E$.

Figure 5:
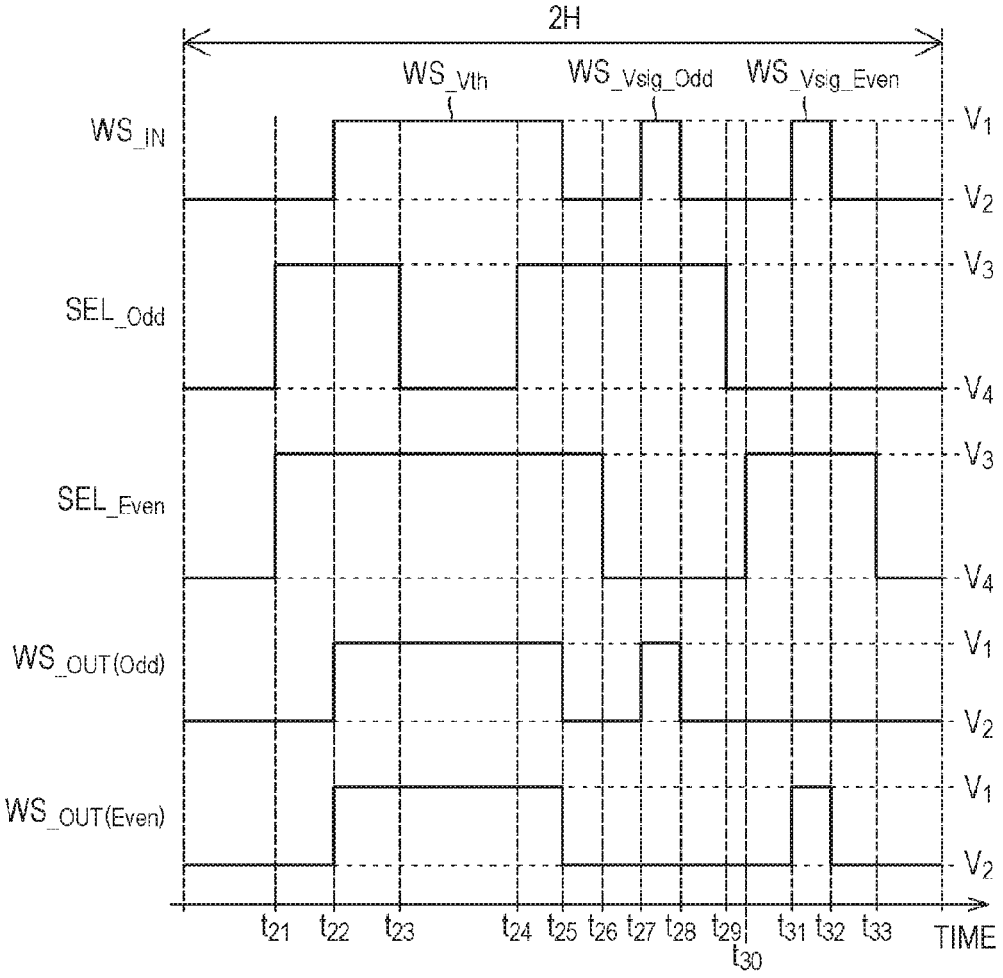
FIG. 5 is a timing waveform diagram illustrating a timing relationship of an input signal $WS_{_IN}$, selection signals $SEL_{_Odd}$ and $SEL_{_Even}$, and an output signal $WS_{_OUT}$ in the selector circuit unit according to the reference example.

FIG. 5 shows timing relationships of the input signal $WS_{IN}$, the selection signals $SEL_{Odd}$ and $SEL_{Even}$, and the output signal $WS_{OUT}$ in the selector circuit unit 50A according to the reference example. Here, the input signal $WS_{IN}$ corresponds to each of writing and scanning signals (hereinafter also simply referred to as a "scanning signal" in some cases) $WS_{1,2}$ to $WS_{1079,1080}$ which are input from the writing and scanning unit 40 to the selector circuit unit 50A, and the output signal $WS_{OUT}$ corresponds to each of scanning signals $WS_1$ to $WS_{1080}$ which are output from the selector circuit unit 50A to the scanning lines $\mathbf{31}_1$ to $\mathbf{31}_{1080}$.

FIG. 5 shows the timing relationships in a period 2H. In addition, a high level of the input signal $WS_{IN}$ and the output signal $WS_{OUT}$ is represented as $V_1$, the low level thereof is represented as $V_2$, a high level of the selection signals $SEL_{Odd}$ and $SEL_{Even}$ is represented as $V_3$, and the low level thereof is represented as $V_4$. Here, $V_1$ and $V_3$ are positive voltages, and $V_2$ and $V_4$ are negative voltages, for example.

In the timing waveform diagram in FIG. 5, the input signal $WS_{IN}$ is in the active state (the high level state in this example) in a period from the time $t_{22}$ to the time $t_{25}$, a period from the time $t_{27}$ to the time $t_{28}$, and a period from the time $t_{31}$ to the time $t_{32}$. In relation to the input signal $WS_{IN}$, a signal which is brought into the active state in a period from the time $t_{22}$ to the time $t_{25}$ is a scanning signal $WS_{Vth}$, for threshold value correction which is common to two adjacent pixel rows, namely two pixel rows configured of an odd pixel row and an even pixel row. A signal which is brought into the active state in a period from the time $t_{27}$ to the time $t_{28}$ is a scanning signal $WS_{Vsig_Odd}$ for writing a signal in each odd pixel row, and the signal which is brought into the active state in a period from the time $t_{31}$ to the $t_{32}$ is a scanning signal $WS_{Vsig_Even}$ for writing a signal in each even pixel row. That is, the scanning signal $WS_{Vth}$ for threshold value correction, the scanning signal $WS_{Vsig_Odd}$ for writing a signal in each odd row, and the scanning signal $WS_{Vsig_Even}$ for writing a signal in each even row are input from the writing and scanning unit 40 to the selector circuit unit 50A in the time series manner.

The selection signal $SEL_{Odd}$ for each odd row is in the active state in a period from the time $t_{21}$ to the time $t_{23}$ and a period from the time $t_{24}$ to the time $t_{29}$. The selection transistors $\mathbf{52}_1, \mathbf{52}_3, \ldots, \mathbf{52}_{1079}$ corresponding to the odd pixel rows are brought into the conductive state in response to the selection signal $SEL_{Odd}$, extract the scanning signal $WS_{Vth}$ for threshold value correction and the scanning signal $WS_{Vsig_Odd}$ for writing a signal from the input signal $WS_{IN}$, and output the scanning signal $WS_{OUT_Odd}$ for each odd pixel row. The selection signal $SEL_{Even}$ for each even row is in the active state in a period from the time $t_{21}$ to the time $t_{26}$ and a period from the time $t_{30}$ to the time $t_{33}$. The selection transistors $\mathbf{52}_2, \mathbf{52}_4, \ldots, \mathbf{52}_{1080}$ corresponding to the even pixel rows are brought into the conductive state in response to the selection signal $SEL_{Even}$, extract the scanning signal $WS_{Vth}$ for threshold value correction and the scanning signal $WS_{Vsig_Even}$ for writing a signal from the input terminal $WS_{IN}$, and output the scanning signal $WS_{OUT_Even}$ for each even pixel row.

As described above, the selector circuit unit 50A according to the reference example has a function of regarding a plurality of pixel rows (horizontal lines) as a unit, selecting a plurality of scanning signals, which are supplied in the time series manner in accordance with a unit of the plurality of pixel rows, in turn, and supplying (allocating) the selected scanning signals to the plurality of pixel rows. In the aforementioned example, the scanning signal $WS_{Vsig_Odd}$ for writing a signal and a scanning signal $WS_{Vsig_Even}$ for writing a signal, which are input in the time series manner, are allocated to each of the scanning lines $\mathbf{31}_1, \mathbf{31}_3, \ldots$ on the odd rows and the scanning lines $\mathbf{31}_2, \mathbf{31}_4, \ldots$ on the even rows, respectively.

STC Driving

In addition to the aforementioned function, the selector circuit unit 50A according to the reference example also has a function of performing simultaneous threshold cancel (STC) driving in which the scanning signal $WS_{Vth}$ for threshold value correction output from the writing and scanning unit 40 is simultaneously selected for a unit of the pixel rows and the threshold value correcting operation is simultaneously performed for the plurality of pixel rows. According to the STC drive method, it is possible to achieve the effect and the advantage in that sufficient time can be secures as the threshold value correction period, as compared with the case in which the threshold value correcting operation is performed at a different timing for each of the plurality of pixel rows even if time allocated as one horizontal period is shortened due to an increase in frame rate, in the same manner as the aforementioned drive method based on the divided threshold value correction. The STC drive method can be employed in combination with the drive method based on the divided threshold value correction or can be employed alone.

In the case of employing the STC drive method, the writing and scanning unit 40 outputs the scanning signal for the threshold value correction, which is common to a unit of the plurality of pixel rows, prior to the output of a plurality of scanning signals for writing signals corresponding to a unit of the plurality of pixels. In the above example, the scanning signal WS for the threshold value correction common to the pixel rows is output prior to the output of the scanning signals $WS_{_Vsig_Odd}$ and $WS_{_Vsig_Even}$ for writing signals in two adjacent pixel rows, namely an odd row and an even row as shown in the timing waveform diagram in FIG. 5.

Figure 6A:
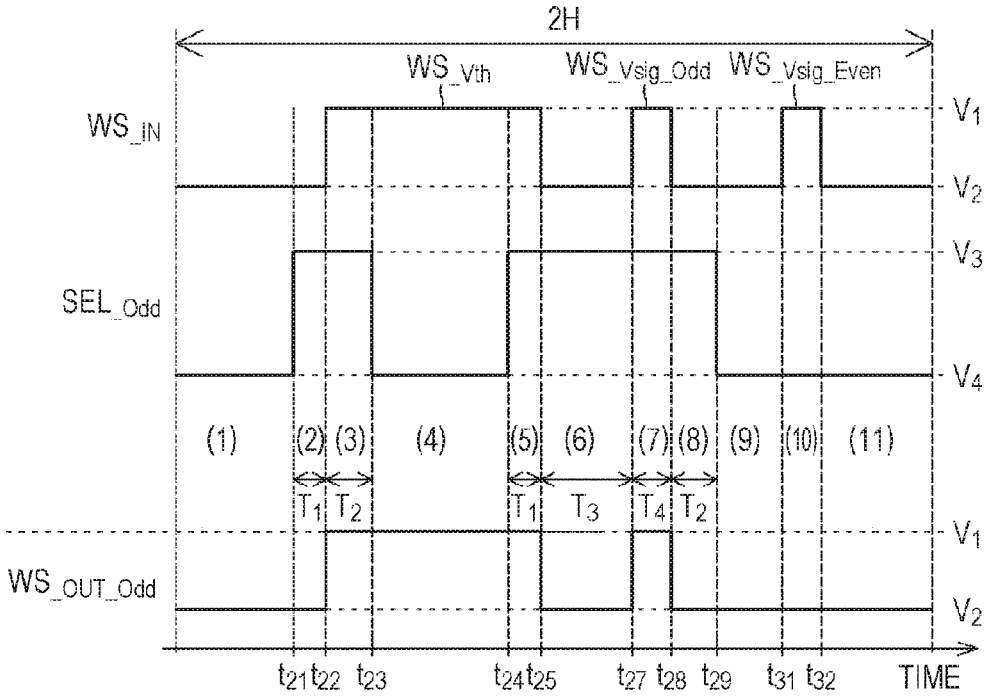
FIG. 6A is a timing waveform diagram illustrating a timing relationship of the input signal $WS_{_IN}$, a selection signal $SEL_{_Odd}$, and an output signal $WS_{_OUT}$ (Odd) in odd pixel rows.
Figure 6B:
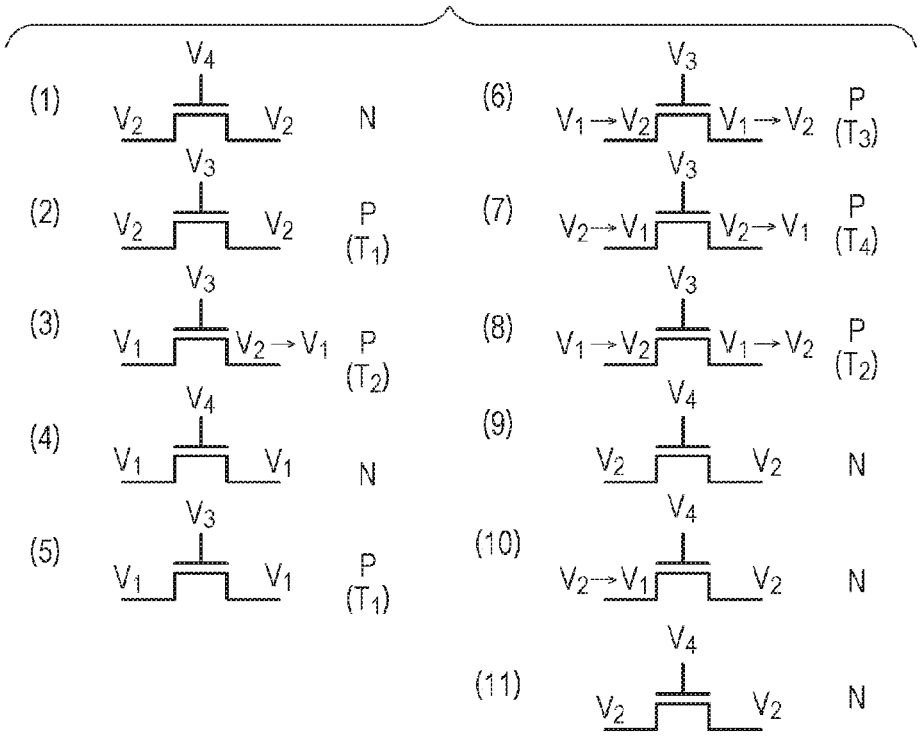
FIG. 6B is an explanatory diagram for operation points of a selection transistor in the respective operation modes (1) to (11)

Here, the selection transistors $\mathbf{52}_1$, $\mathbf{52}_3$, . . . , $\mathbf{52}_{1079}$ corresponding to the odd pixel rows will be exemplified, and operation points of the selection transistors 52 in the respective operation modes will be considered with reference to FIGS. 6A and 6B. FIG. 6A is a timing waveform diagram showing timing relationships of the input signal $WS_{_IN}$, the selection signal $SEL_{_Odd}$, and the output signal $WS_{_OUT_Odd}$ for the odd pixel rows. FIG. 6B is an explanatory diagram of the operation points of each selection transistor 52 in the respective operation modes (1) to (11).

In the period 2H (horizontal periods) shown in FIG. 6A, the period before the time $t_{21}$ corresponds to the operation mode (1), the period from the time $t_{21}$ to the time $t_{22}$ corresponds to the operation mode (2), the period from the time $t_{22}$ to the time $t_{23}$ corresponds to the operation mode (3), the period from the time $t_{23}$ to the time $t_{24}$ corresponds to the operation mode (4), and the period from the time $t_{24}$ to the time $t_{25}$ corresponds to the operation mode (5). In addition, the period from the time $t_{25}$ to the time $t_{27}$ corresponds to the operation mode (6), the period from the time $t_{27}$ to the time $t_{28}$ corresponds to the operation mode (7), the period from the time $t_{28}$ to the time $t_{29}$ corresponds to the operation mode (8), the period from the time $t_{29}$ to the time $t_{31}$ corresponds to the operation mode (9), the period from the time $t_{31}$ to the time $t_{32}$ corresponds to the operation mode (10), and the period after the time $t_{32}$ corresponds to the operation mode (11).

Figure 7A:
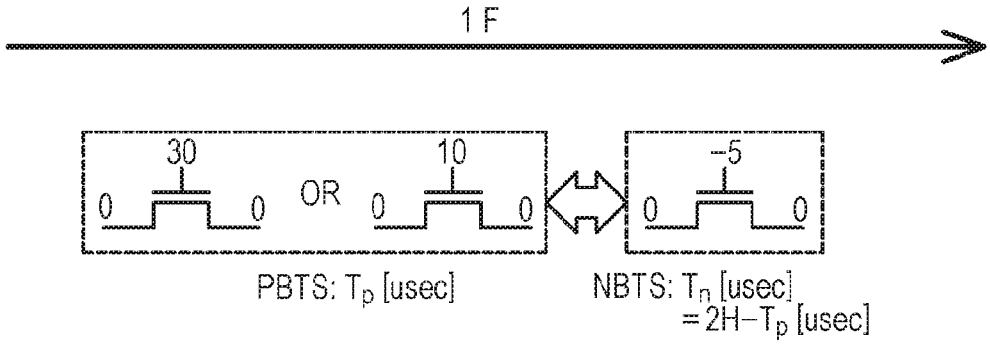
FIG. 7A is a diagram illustrating application states of a positive bias and a negative bias during a display frame period according to the reference example.

According to the drive timing shown in FIG. 6A, positive bias temperature stress (PETS) occupies $T_p$[μsec] in 2H, and negative bias temperature stress (NBTS) occupies $T_n$ [μsec] in 2H ($T_p<T_n$). When it is assumed that $T_1$ represents the time corresponding to the operation mode (2) and the operation mode (5), $T_2$ represents the time corresponding to the operation mode (3) and the operation mode (8), $T_3$ represents the time corresponding to the operation mode (6), and $T_4$ represents the time corresponding to the operation mode (7) in the positive bias period shown in FIG. 6A, $T_p=2T_1+2T_2+T_3+T_4$ is satisfied. In addition, $T_n=2H-T_p$ is satisfied. Such a positive bias and a negative bias are continuously applied to the selection transistor 52 in one display frame period (1F) as shown in FIG. 7A.

Figure 8:
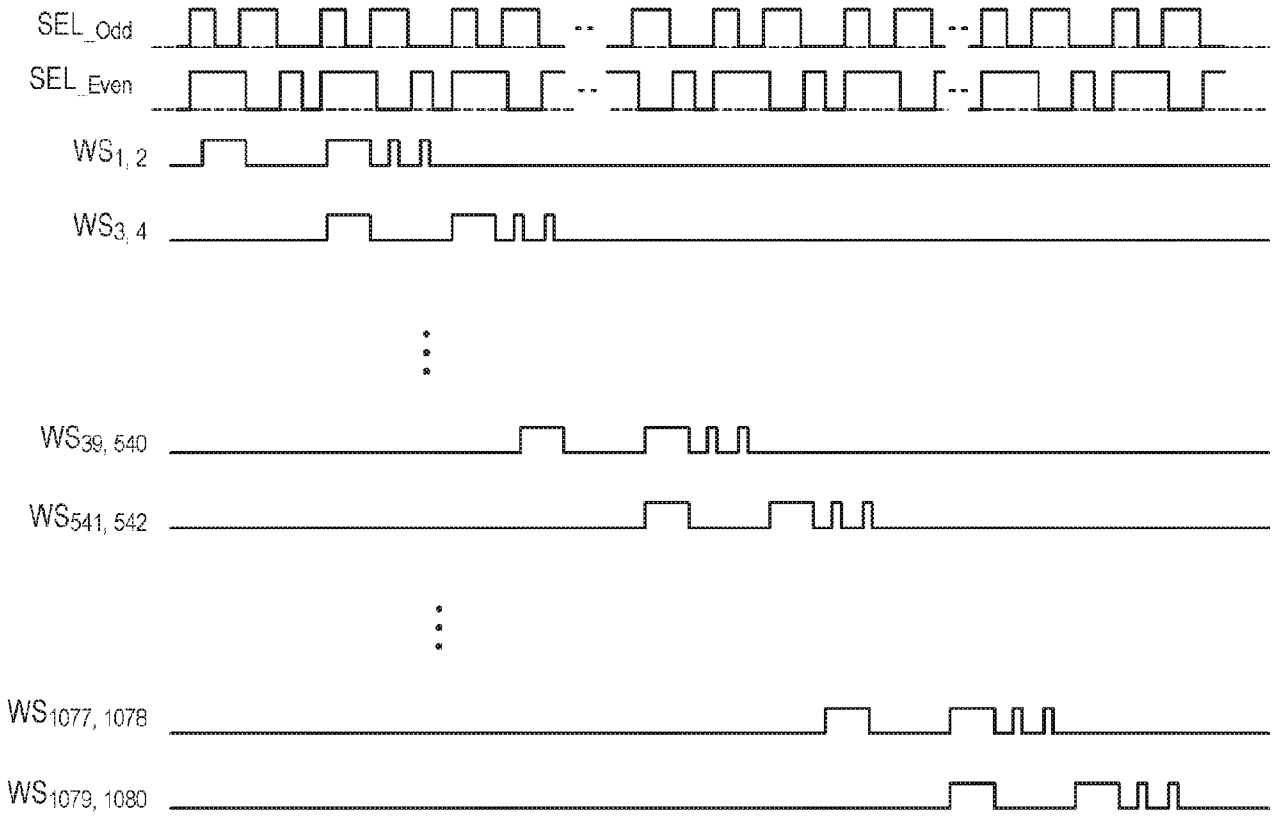
FIG. 8 is a timing waveform diagram illustrating a timing relationship of selection signals $SEL_{_Odd}$ and $SEL_{_Even}$ and scanning signals $WS_{1,2}$ to $WS_{1079,1080}$ in the selector circuit unit according to the reference example.

FIG. 8 shows timing relationships of the selection signals $SEL_{_Odd}$ and $SEL_{_Even}$ and the scanning signals $WS_{1,2}$ to $WS_{1079,1080}$ in the case of the selector circuit unit 50A according to the reference example. The voltage shown in FIG. 6B is continuously applied to the selection transistors 52 configuring the selector circuit unit 50A in one display frame (1F). If the selection transistors 52 is greatly affected by the positive or negative application voltage at this time, there is a case where variations in properties of the selection transistors 52 temporally occurs due to the properties of the selection transistors 52, for example. There is a case where the properties of the selection transistors 52 shifts in the enhancement direction or shifts in the depletion direction due to the operation in the switching period (selection assigned period), for example. If the properties of the selection transistors 52 vary, there is a possibility that operation failures of the selector circuit unit 50A are caused.

Selector Circuit Unit According to Embodiment

Figure 9:
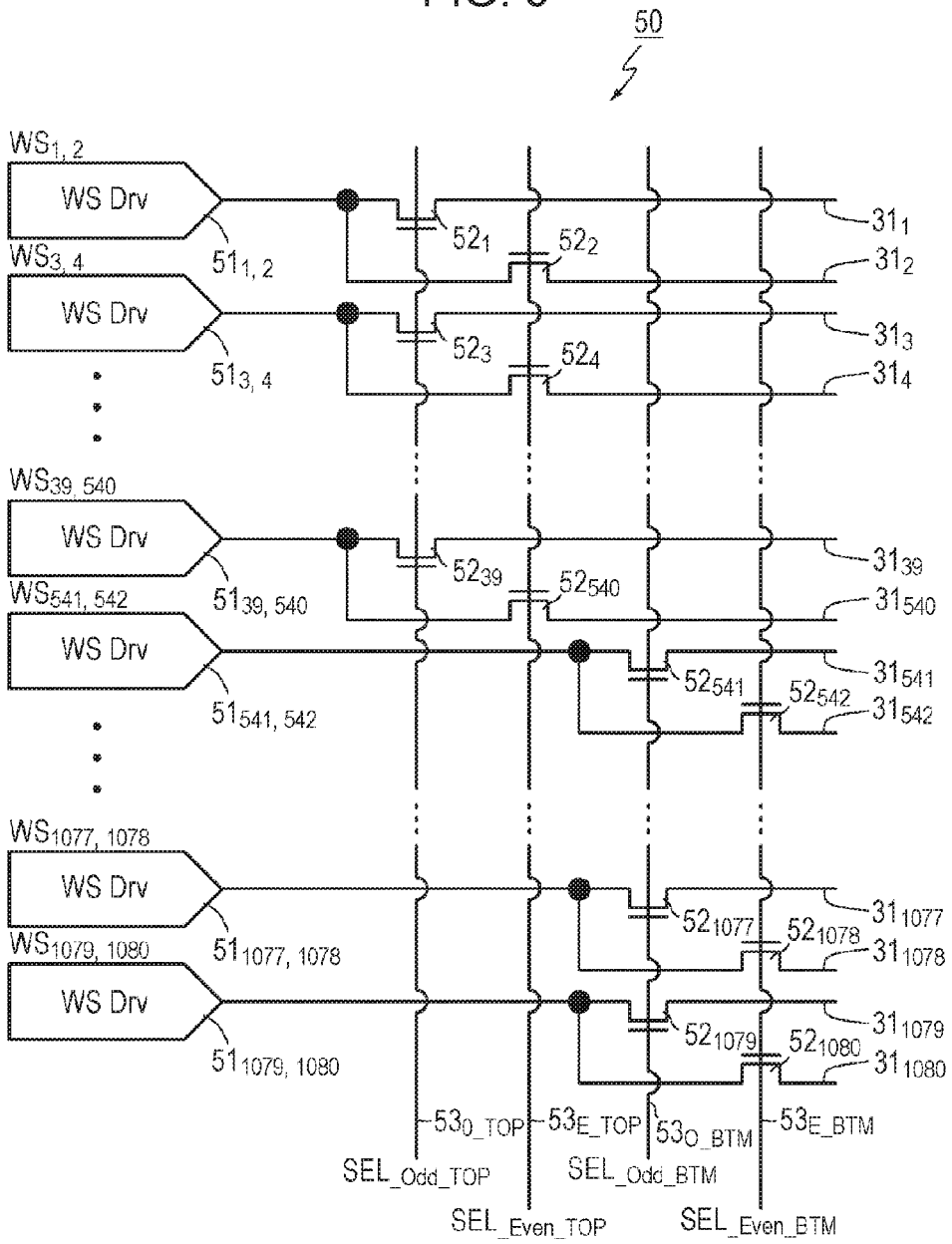
FIG. 9 is a circuit diagram illustrating a circuit configuration of the selector circuit unit according to the embodiment.

It is desirable to solve the operation failures of the selector circuit unit 50A, which is caused by the aforementioned temporal variations in the properties of the selection transistors 52, by a selector circuit unit 50 according to an embodiment which will be described below. FIG. 9 is a circuit diagram illustrating a circuit configuration of the selector circuit unit 50 according to the embodiment. Here, a case in which the number of pixel rows (the number of horizontal lines) in the pixel array unit 30 is 1080 (Full HD; image resolution is 1920 pixels×1080 pixels) will be described as an example.

As shown in FIG. 9, the selector circuit unit 50 according to the embodiment includes input terminals $\mathbf{51}_{1,2}$ to $\mathbf{51}_{1079,1080}$, the number of which is ½ of the number of horizontal lines, and is configured of N-channel-type selection transistors $\mathbf{52}_1$ to $\mathbf{52}_{1080}$ of transparent oxide semiconductors, for example, and two selection transistors are provided for each input terminal 51 in the same manner as the selector circuit unit 50A according to the reference example. However, the selector circuit unit 50 according to the embodiment has a configuration which is different from that of the selector circuit unit 50A according to the reference example in the following points.

First, according to the organic EL display apparatus 10 in which the selector circuit unit 50 according to the embodiment is used, the m pixel rows in the pixel array unit 30 are divided into a plurality of groups, for example, two groups configured of an upper group and a lower group. In the case of the Full HD (1920 pixels×1080 pixels), the first pixel row to the 540th pixel row belong to the upper group, and the 541st pixel row to the 1080th pixel row belong to the lower group.

Selection lines $\mathbf{53}_{O_TOP}$ are arranged for the selection transistors $\mathbf{52}_1$, $\mathbf{52}_3$, $\mathbf{52}_{539}$ corresponding to the odd pixel rows which belong to the upper group, and selection lines $\mathbf{53}_{E_TOP}$ are arranged for the selection transistors $\mathbf{52}_2$, $\mathbf{52}_4$, . . . , $\mathbf{52}_{540}$ corresponding to the even pixel rows. In addition, selection lines $\mathbf{53}_{O_BTM}$ are arranged for the selection transistors $\mathbf{52}_{541}$, . . . , $\mathbf{52}_{1077}$, $\mathbf{52}_{1079}$ corresponding to the odd pixel rows which belong to the lower group, and selection lines $\mathbf{53}_{E_BTM}$ are arranged for the selection transistors $\mathbf{52}_{542}$, . . . , $\mathbf{52}_{1078}$, $\mathbf{52}_{1080}$ corresponding to the even pixel rows.

In addition, selection signals $SEL_{_Odd_TOP}$ for the odd rows belonging to the upper group are provided to the selection lines $\mathbf{53}_{O_TOP}$, and selection signals $SEL_{_Even_TOP}$ for even rows belonging to the upper group are provided to the selection lines $\mathbf{53}_{E_TOP}$. Moreover, selection signals $SEL_{_Odd_BTM}$ for the odd rows belonging to the lower group are provided to the selection lines $\mathbf{53}_{O_BTM}$, and selection signals $SEL_{_Even_BTM}$ for the even rows belonging to the lower group are provided to the selection lines $\mathbf{53}_{E_BTM}$.

Figure 10:
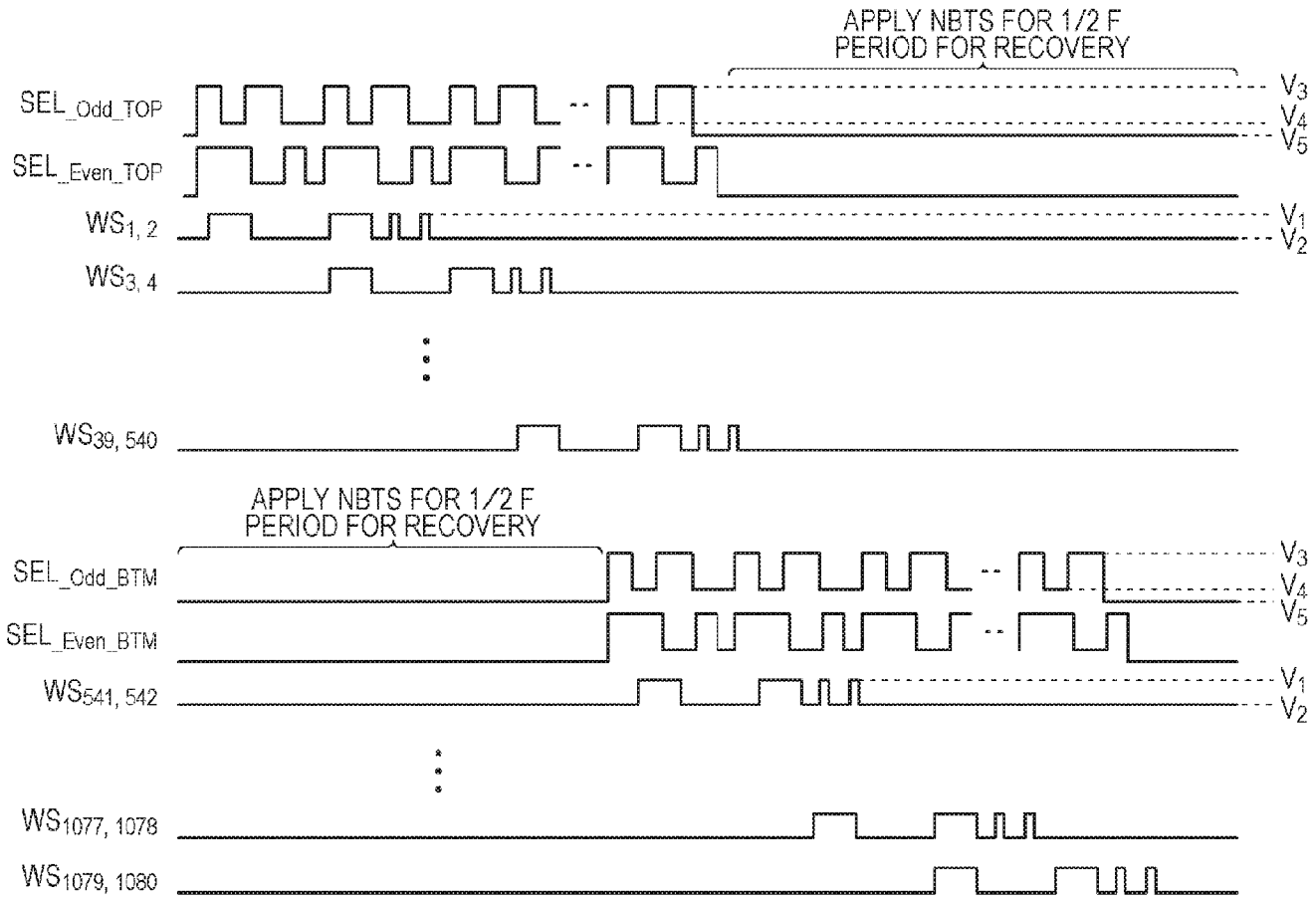
FIG. 10 is a timing waveform diagram illustrating a timing relationship of selection signals $SEL_{_Odd_TOP}$ and $SEL_{_Even_TOP}$ for an upper group and selection signals $SEL_{_Odd_BTM}$ and $SEL_{_Even_BTM}$ for a lower group and scanning signals $WS_{1,2}$ to $WS_{1079,1080}$ in the selector circuit unit according to the embodiment.

FIG. 10 shows timing relationships of the selection signals $SEL_{_Odd_TOP}$ and $SEL_{_Even_TOP}$ for the upper group, the selection signals $SEL_{_Odd_BTM}$ and $SEL_{_Even_BTM}$ for the lower group, and the scanning signals $WS_{1,2}$ to $WS_{1079,1080}$ in the case of the selector circuit unit 50 according to the embodiment. In the timing waveform in FIG. 10, a high level (positive voltage) of the selection signals $SEL_{_Odd_TOP}$ and $SEL_{_Even_TOP}$ and the selection signals $SEL_{_Odd_BTM}$ and $SEL_{_Even_BTM}$ is represented as $V_3$, and a low level (negative voltage) thereof is represented as $V_4$ in a manner corresponding to the timing waveform diagram in FIG. 5, for example. In addition, a voltage $V_5$ which is lower than the voltage $V_4$ is a third voltage of the selection signals $SEL_{_Odd_TOP}$ and $SEL_{_Even_TOP}$ and the selection signals $SEL_{_Odd_BTM}$ and $SEL_{_Even_BTM}$.

In the case in which the m pixel rows in the pixel array unit 30 are divided into the two upper and lower groups, it is necessary for the selection signals $SEL_{_Odd_TOP}$ and $SEL_{_Even_TOP}$ for the upper group to select the scanning signals WS from the first pixel row to the 540th pixel row. For this reason, the selection signals $SEL_{_Odd_TOP}$ and $SEL_{_Even_TOP}$ for the upper group are brought into the active state at a timing shown in FIG. 5 in the first half display frame (F) period as shown in FIG. 10. In addition, it is necessary for the selection signals $SEL_{_Odd_BTM}$ and $SEL_{_Even_BTM}$ for the lower group to select the scanning signals WS from the 541st pixel row to the 1080th pixel row. For this reason, the selection signals $SEL_{_Odd_BTM}$ and $SEL_{_Even_BTM}$ for the lower group are brought into the active state at a timing shown in FIG. 5 in the second half display frame period as shown in FIG. 10.

In relation to the selection signals $SEL_{_Odd_TOP}$ and $SEL_{_Even_TOP}$ for the upper group, the first half display frame period in one display frame period corresponds to a selection assigned period during which the selection signals $SEL_{_Odd_TOP}$ and $SEL_{_Even_TOP}$ for the upper group are assigned to select the scanning signals WS. In relation to the selection signals $SEL_{_Odd_BTM}$ and $SEL_{_Even_BTM}$ for the lower group, the second half display frame period in one display frame period corresponds to the selection assigned period during which the selection signals $SEL_{_Odd_BTM}$ and $SEL_{_Even_BTM}$ for the lower group are assigned to select the scanning signals WS. That is, one display frame period of the selection transistors $\mathbf{52}_1$ to $\mathbf{52}_{1080}$ which configure the selector circuit unit 50 is divided into two selection assigned periods.

In relation to the selection signals $SEL_{_Odd_TOP}$ and $SEL_{_Even_TOP}$ and the selection signals $SEL_{_Odd_BTM}$ and $SEL_{_Even_BTM}$, the period other than the selection assigned period is a period with no relationship with the operation of selecting the scanning signals WS, that is, a period which does not contribute to the selection of the scanning signals WS. Therefore, the selection signals $SEL_{_Odd_TOP}$ and $SEL_{_Even_TOP}$ and the selection signals $SEL_{_Odd_BTM}$ and $SEL_{_Even_BTM}$ may be in an arbitrary state, namely in the active state or in the non-active state in the period other than the selection assigned period.

That is, any voltage can be freely set as the selection signals $SEL_{_Odd_TOP}$ and $SEL_{_Even_TOP}$ and the selection signals $SEL_{_Odd_BTM}$ and $SEL_{_Even_BTM}$ in the period other than the selection assigned period. Thus, a desired voltage is set for the selection signals $SEL_{_Odd_TOP}$ and $SEL_{_Even_TOP}$ and the selection signals $SEL_{_Odd_BTM}$ and $SEL_{_Even_BTM}$ in a predetermined period other than the selection assigned period. In doing so, the desired voltage is applied to the gate electrodes of the selection transistors $\mathbf{52}_1$ to $\mathbf{52}_{1080}$ in the predetermined period other than the selection assigned period.

The desired voltage to be applied to the selection transistors $\mathbf{52}_1$ to $\mathbf{52}_{1080}$ in the predetermined period other than the selection assigned period are voltages suppressing the shift of the properties of the selection transistors $\mathbf{52}_1$ to $\mathbf{52}_{1080}$, which is being driven, in a specific direction. Specifically, when the selection transistors $\mathbf{52}_1$ to $\mathbf{52}_{1080}$ are the N-channel-type transistors as in the embodiment, a negative voltage is set as the desired voltage in a case in which the properties of the selection transistors 52 tend to shift in the enhancement direction due to the operation in the switching period (selection assigned period) and a positive voltage is set in a case in which the properties of the selection transistors 52 tend to shift in the depletion direction. Here, the "predetermined period" other than the selection assigned period may be the entire period other than the selection assigned period or may be a predetermined period (a part of the period) other than the selection assigned period. In the former case, a constant voltage is set as a desired voltage. In the latter case, a pulse voltage is set as a desired voltage.

As described above, one display frame period of the selection transistors $\mathbf{52}_1$ to $\mathbf{52}_{1080}$ which configure the selector circuit unit 50 is divided into a plurality of (two in this example) selection assigned periods. Then, the desired voltage is applied to the gate electrodes of the selection transistors $\mathbf{52}_1$ to $\mathbf{52}_{1080}$ in the predetermined period other than the selection assigned period. Specifically, a negative voltage is applied in the case in which the properties of the selection transistors $\mathbf{52}_1$ to $\mathbf{52}_{1080}$ tend to shift in the enhancement direction due to the operation in the switching period, and a positive voltage is applied in the case in which the properties of the selection transistors $\mathbf{52}_1$ to $\mathbf{52}_{1080}$ tend to shift in the depletion direction.

Figure 7B:
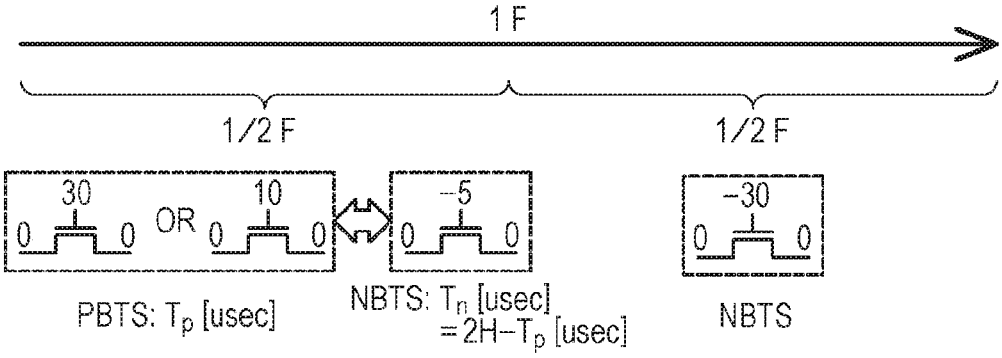
FIG. 7B is a diagram illustrating application states of the positive bias and the negative bias during a display frame period according to the embodiment.

In the embodiment, a case in which the negative voltage (the voltage $V_5$ which is lower than the voltage $V_4$) is applied is exemplified as shown in FIG. 10. FIG. 7B shows application states of a positive bias and a negative bias in one display frame period according to the embodiment. It is possible to suppress temporal variations in the properties of the selection transistors $\mathbf{52}_1$ to $\mathbf{52}_{1080}$ with this configuration even if the selection transistors $\mathbf{52}_1$ to $\mathbf{52}_{1080}$ are greatly affected by one of positive and negative applied voltages, and to thereby prevent operation failures of the selector circuit unit, which are caused by the temporal variations in the properties of the selection transistors $\mathbf{52}_1$ to $\mathbf{52}_{1080}$.

Modification Example

Although the N-channel-type transistors of transparent oxide semiconductors are used as the selection transistors $\mathbf{52}_1$ to $\mathbf{52}_{1080}$ which configure the selector circuit unit 50 in the aforementioned embodiment, the selection transistors are not limited to such transparent oxide semiconductors, and P-channel-type transistors can also be used.

Although the circuit configuration of 2Tr2C is employed as the drive circuit for driving the organic EL element 21 in the aforementioned embodiment, the circuit configuration is not limited thereto, and the auxiliary capacitance 25 can be omitted in the case in which the equivalent capacitance of the organic EL element 21 is sufficiently large. Furthermore, it is also possible to increase the number of transistors as necessary. For example, another configuration in which a dedicated switching transistor is provided and the switching transistor is caused to take the reference voltage $V_{ofs}$ is also applicable instead of the configuration in which the reference voltage $V_{ofs}$ is taken by the writing transistor 23 from the signal line 33. In addition, another configuration is also applicable in which a switching transistor is connected to the drive transistor 22 in series and the switching transistor is caused to control the light emission and non-emission of the organic EL element 21.

Although the STC driving in which two pixel rows (lines) are handled as a unit is employed in the aforementioned embodiment, the drive method is not limited to the two-line STC driving, and it is also possible to apply the technique of the present disclosure to STC driving of three or more lines. Furthermore, the present disclosure is not limited to the application to the selector circuit unit 50 which employs the STC drive method, and may be applied to any configuration in which the scanning signals WS input in the time-series manner are selected in turn and are allocated to the respective scanning lines 31 in a unit of a plurality of pixel rows.

The present disclosure can be configured as follows.

[1] A display apparatus including: a pixel array unit configured such that a pixel circuit including a light emitting unit, a writing transistor for writing video signals, and a drive transistor for driving the light emitting unit based on the video signals written by the writing transistor is arranged in a matrix form; a signal output unit configured to regard a plurality of pixel rows in the pixel array unit as a unit and output, in a time-series manner, a plurality of video signals corresponding to a unit of the plurality of pixel rows to signal lines arranged respectively for pixel columns in the pixel array unit during a plurality of horizontal periods corresponding to the number of rows in a unit; a writing and scanning unit configured to output, in the time-series manner, a plurality of scanning signals for writing the signals, which correspond to a unit of the plurality of pixel rows; and a selector circuit unit configured to select, in turn, the plurality of scanning signals for writing the signals, which are output from the writing and scanning unit in the time-series manner, and allocate the selected scanning signal to each of scanning lines of a unit of the plurality of pixel rows, wherein in the selector circuit unit, a selection assigned period in a display frame period of the selection transistor configuring the selector circuit unit is divided into a plurality of periods, and a desired voltage is applied to a gate electrode of the selection transistor during a specific period other than the selection assigned period.

[2] The display apparatus according to [1], wherein the pixel circuit has a function of threshold value correction processing for causing a source voltage of the drive transistor to vary toward a voltage obtained by subtracting a threshold voltage of the drive transistor from an initialization voltage of a gate voltage of the drive transistor, and wherein the signal output unit outputs a reference voltage, which functions as an initialization voltage of the threshold value correction processing, to the signal lines prior to the output of the plurality of video signals corresponding to a unit of the plurality of pixel TOWS.

[3] The display apparatus according to [2], wherein the writing and scanning unit outputs a scanning signal for the threshold value correction, which is common to a unit of the plurality of pixel rows, prior to the output of the plurality of scanning signals for writing the signals corresponding to a unit of the plurality of pixel rows.

[4] The display apparatus according to [3], wherein the selector circuit unit selects the scanning signal for the threshold value correction, which is output from the writing and scanning unit, at the same timing for a unit of the plurality of pixel rows.

[5] The display apparatus according to any one of [1] to [4], wherein the desired voltage is a voltage suppressing shift of properties of the selection transistor, which is being driven, in a specific direction.

[6] The display apparatus according to [5], wherein when the selection transistor is an N-channel type transistor, a negative voltage is set as the desired voltage in a case where the properties of the selection transistor tend to shift in an enhancement direction, or a positive voltage is set as the desired voltage in a case where the properties of the selection transistor tend to shift in a depletion direction.

[7] The display apparatus according to [5] or [6], wherein the desired voltage is a constant voltage or a pulse voltage.

[8] A drive method of a display apparatus which includes a pixel array unit configured such that a pixel circuit including a light emitting unit, a writing transistor for writing video signals, and a drive transistor for driving the light emitting unit based on the video signals written by the writing transistor is arranged in a matrix form, a signal output unit configured to regard a plurality of pixel rows in the pixel array unit as a unit and output, in a time-series manner, a plurality of video signals corresponding to a unit of the plurality of pixel rows to signal lines arranged respectively for pixel columns in the pixel array unit during a plurality of horizontal periods corresponding to the number of rows in a unit, a writing and scanning unit configured to output, in the time-series manner, a plurality of scanning signals for writing the signals, which correspond to a unit of the plurality of pixel rows, and a selector circuit unit configured to select, in turn, the plurality of scanning signals for writing the signals, which are output from the writing and scanning unit in the time-series manner, and allocate the selected scanning signal to each of scanning lines of a unit of the plurality of pixel rows, the method including: dividing a selection assigned period in a display frame period of the selection transistor configuring the selector circuit unit into a plurality of periods; and applying a desired voltage to a gate electrode of the selection transistor during a specific period other than the selection assigned period.

It should be understood by those skilled in the art that various modifications, combinations, sub-combinations and alterations may occur depending on design requirements and other factors insofar as they are within the scope of the appended claims or the equivalents thereof.

What is claimed is:

1. A display apparatus comprising:

a pixel array unit including a plurality of pixel circuits arranged in a matrix form, at least one pixel circuit of the plurality of pixel circuits including a light emitting unit, a writing transistor configured to write video signals, and a drive transistor configured to drive the light emitting unit based on the video signals that have been written by the writing transistor, wherein a subset of a plurality of pixel rows in the pixel array unit are a unit;

a signal output unit configured to output, in a time-series manner, a plurality of video signals corresponding to the subset of the plurality of pixel rows to a plurality of signal lines arranged respectively for pixel columns in the pixel array unit during a plurality of horizontal periods corresponding to a number of the subset of the plurality of pixel rows in the unit;

a writing and scanning unit configured to output, in the time-series manner, a plurality of scanning signals for writing the video signals, the plurality of scanning signals corresponding to the subset of the plurality of pixel rows; and a selector circuit unit electrically connected between the writing and scanning unit and the plurality of pixel rows, wherein the selector circuit unit includes a plurality of selection transistors and is configured to select, in turn, one of the plurality of scanning signals for writing the video signals that is output from the writing and scanning unit in the time-series manner, and allocate the one of the plurality of scanning signals that has been selected to one scanning line of a plurality of scanning lines of the subset of the plurality of pixel rows, wherein a selection assigned period in a display frame period of the plurality of selection transistors is divided into a plurality of periods, wherein a predetermined voltage is applied to a gate electrode of at least one of the plurality of selection transistors during a specific period other than the selection assigned period, and wherein the predetermined voltage is configured to suppress a shift in electrical properties of the at least one of the plurality of selection transistors.

2. The display apparatus according to claim 1, wherein the at least one pixel circuit of the plurality of pixel circuits has a function of threshold value correction processing for causing a source voltage of the drive transistor to vary toward a voltage obtained by subtracting a threshold voltage of the drive transistor from an initialization voltage of a gate voltage of the drive transistor, wherein, prior to the output of the plurality of video signals corresponding to the subset of the plurality of pixel rows, the signal output unit is further configured to output a reference voltage to the plurality of signal lines, and wherein the reference voltage is the initialization voltage of the function of threshold value correction processing.

3. The display apparatus according to claim 2, wherein, prior to the output of the plurality of scanning signals for writing the video signals corresponding to the subset of the plurality of pixel rows, the writing and scanning unit is further configured to output a scanning signal that is common to the subset of the plurality of pixel rows for the function of threshold value correction processing.

4. The display apparatus according to claim 3, wherein the selector circuit unit is further configured to select the scanning signal that is common to the subset of the plurality of pixel rows at the same timing for the subset of the plurality of pixel rows.

5. The display apparatus according to claim 1, wherein the predetermined voltage is configured to suppress the shift in the electrical properties of the at least one of the plurality of selection transistors when the at least one of the plurality of selection transistors is electrically driven in a specific direction.

6. The display apparatus according to claim 5, wherein the at least one of the plurality of selection transistors is an N-channel type transistor, wherein the predetermined voltage is a negative voltage that suppresses the shift in the electrical properties of the at least one of the plurality of selection transistors in an enhancement direction, or wherein the predetermined voltage is a positive voltage that suppresses the shift in the electrical properties of the at least one of the plurality of selection transistors in a depletion direction.

7. The display apparatus according to claim 5, wherein the predetermined voltage is a constant voltage or a pulse voltage.

8. A drive method of a display apparatus, the display apparatus includes a pixel array unit including a plurality of pixel circuits arranged in a matrix form, at least one of the plurality of pixel circuits including a light emitting unit, a writing transistor configured to write video signals, and a drive transistor configured to drive the light emitting unit based on the video signals that have been written by the writing transistor, wherein a subset of a plurality of pixel rows in the pixel array unit are a unit, a signal output unit configured to output, in a time-series manner, a plurality of video signals corresponding to the subset of the plurality of pixel rows to a plurality of signal lines arranged respectively for pixel columns in the pixel array unit during a plurality of horizontal periods corresponding to a number of the subset of the plurality of pixel rows in the unit, a writing and scanning unit configured to output, in the time-series manner, a plurality of scanning signals for writing the video signals, the plurality of scanning signals corresponding to the subset of the plurality of pixel rows, and a selector circuit unit electrically connected between the writing and scanning unit and the plurality of pixel rows, wherein the selector circuit unit includes a plurality of selection transistors and is configured to select, in turn, one of the plurality of scanning signals for writing the video signals that is output from the writing and scanning unit in the time-series manner, and allocate the one of the plurality of scanning signals that has been selected to one scanning line of a plurality of scanning lines of the subset of the plurality of pixel rows, the method comprising:

dividing a selection assigned period in a display frame period of the plurality of selection transistors into a plurality of periods; and applying a predetermined voltage to a gate electrode of at least one of the plurality of selection transistors during a specific period other than the selection assigned period, wherein the predetermined voltage is configured to suppress a shift in electrical properties of the at least one of the plurality of selection transistors.

9. An electronic apparatus comprising:

a display apparatus including a pixel array unit including a plurality of pixel circuits arranged in a matrix form, at least one pixel circuit of the plurality of pixel circuits including a light emitting unit, a writing transistor configured to write video signals, and a drive transistor configured to drive the light emitting unit based on the video signals that have been written by the writing transistor, wherein a subset of a plurality of pixel rows in the pixel array unit are a unit;

a signal output unit configured to output, in a time-series manner, a plurality of video signals corresponding to the subset of the plurality of pixel rows to a plurality of signal lines arranged respectively for pixel columns in the pixel array unit during a plurality of horizontal periods corresponding to a number of the subset of the plurality of pixel rows in the unit;

a writing and scanning unit configured to output, in the time-series manner, a plurality of scanning signals for writing the video signals, the plurality of scanning signals corresponding to the subset of the plurality of pixel rows; and a selector circuit unit electrically connected between the writing and scanning unit and the plurality of pixel rows, wherein the selector circuit unit includes a plurality of selection transistors and is configured to select, in turn, one of the plurality of scanning signals for writing the video signals that is output from the writing and scanning unit in the time-series manner, and allocate the one of the plurality of scanning signals that has been selected to one scanning line of a plurality of scanning lines of the subset of the plurality of pixel rows, wherein a selection assigned period in a display frame period of the plurality of selection transistors is divided into a plurality of periods, wherein a predetermined voltage is applied to a gate electrode of at least one of the plurality of selection transistors during a specific period other than the selection assigned period, and wherein the predetermined voltage is configured to suppress a shift in electrical properties of the at least one of the plurality of selection transistors.

10. The electronic apparatus according to claim 9, wherein the at least one pixel circuit of the plurality of pixel circuits has a function of threshold value correction processing for causing a source voltage of the drive transistor to vary toward a voltage obtained by subtracting a threshold voltage of the drive transistor from an initialization voltage of a gate voltage of the drive transistor, wherein, prior to the output of the plurality of video signals corresponding to the subset of the plurality of pixel rows, the signal output unit is further configured to output a reference voltage to the plurality of signal lines, and wherein the reference voltage is the initialization voltage of the function of threshold value correction processing.

11. The electronic apparatus according to claim 10, wherein, prior to the output of the plurality of scanning signals for writing the video signals corresponding to the subset of the plurality of pixel rows, the writing and scanning unit is further configured to output a scanning signal that is common to the subset of the plurality of pixel rows for the function of threshold value correction processing.

12. The electronic apparatus according to claim 11, wherein the selector circuit unit is further configured to select the scanning signal that is common to the subset of the plurality of pixel rows at the same timing for the subset of the plurality of pixel rows.

13. The electronic apparatus according to claim 9, wherein the predetermined voltage is configured to suppress the shift in the electrical properties of the at least one of the plurality of selection transistors when the at least one of the plurality of selection transistors is electrically driven in a specific direction.

14. The electronic apparatus according to claim 13, wherein the at least one of the plurality of selection transistors is an N-channel type transistor, wherein the predetermined voltage is a negative voltage that suppresses the shift in the electrical properties of the at least one of the plurality of selection transistors in an enhancement direction, or wherein the predetermined voltage is a positive voltage that suppresses the shift in the electrical properties of the at least one of the plurality of selection transistors in a depletion direction.

15. The electronic apparatus according to claim 13, wherein the predetermined voltage is a constant voltage or a pulse voltage.

* * * * *